US006089992A

United States Patent [19]

Onuki et al.

[11] Patent Number: 6,089,992

[45] Date of Patent: Jul. 18, 2000

[54] GOLF CLUB HEAD

[75] Inventors: Masahide Onuki, Miki; Tetsuo Yamaguchi; Haruyoshi Minamiguchi, both of Nishinomiya; Akio Ohnishi, Kakogawa; Akihisa Inoue, 11-806, Kawauchi-jutaku, Kawauc, Aoba-ku, Sendai-shi, all of Japan

[73] Assignees: Sumitomo Rubber Industries, Inc., Kobe; Akihisa Inoue, Sendai, both of Japan

[21] Appl. No.: 09/130,444

[22] Filed: Aug. 6, 1998

[30] Foreign Application Priority Data

Aug. 8, 1997 [JP] Japan ..... 9-227363
Sep. 16, 1997 [JP] Japan ..... 9-270423

[51] Int. Cl.[7] ..... A63B 53/04

[52] U.S. Cl. ..... 473/324; 473/342; 473/349

[58] Field of Search ..... 473/342, 349, 473/409, 324, 345

[56] References Cited

U.S. PATENT DOCUMENTS

| | | | |
|---|---|---|---|
| 4,951,953 | 8/1990 | Kim | 473/324 |
| 5,213,148 | 5/1993 | Masumoto et al. | 164/222 |
| 5,458,334 | 10/1995 | Sheldon et al. | 473/349 |
| 5,620,382 | 4/1997 | Cho et al. | 473/331 |
| 5,779,560 | 7/1998 | Buck et al. | 473/342 |
| 5,896,642 | 4/1999 | Peker et al. | 29/522.1 |

FOREIGN PATENT DOCUMENTS

| | | |
|---|---|---|
| 8-109419 | 4/1996 | Japan . |
| 9-322953 | 12/1997 | Japan . |
| 10-155944 | 6/1998 | Japan . |

*Primary Examiner*—Kien T. Nguyen
*Attorney, Agent, or Firm*—Armstrong, Westerman, Hattori, McLeland & Naughton

[57] ABSTRACT

In a golf club head having a face body, the face body is composed of a hybrid of an amorphous phase layer and a crystal phase layer. The crystal phase layer is disposed on a reverse face side of a face. And, thickness of the face body is 0.5 mm to 5.0 mm, thickness of the amorphous phase layer is, on average in whole area of the face body, more than 50% of the thickness of the face body, and thickness of the crystal phase layer is arranged to be 0.01 mm to 3.0 mm.

7 Claims, 28 Drawing Sheets

GOLF CLUB HEAD

BACKGROUND OF THE INVENTION

1. Field of the Invention

This invention relates to a golf club head having a face made of amorphous metal and manufacturing method for the same.

2. Description of the Related Art

Conventionally, as methods for manufacturing amorphous metal, various methods are being proposed. In one of the methods, metal material is melted, rapid-cooled metal (alloy) powder is obtained by rapid cooling solidification of the metal material from a liquid state, and the obtained rapid-cooled metal powder is solidified into a predetermined configuration at under a crystallizing temperature and true densified. In another method, molten metal and alloy are solidified with rapid cooling, and a molded product of amorphous metal in a predetermined configuration is directly obtained.

Most of the amorphous metal obtained by these methods, however, have small mass, and it is difficult to obtain bulk material can be used as a face of a golf club head. For this reason, although a method for obtaining amorphous metal as bulk material by solidification of the rapid-cooled metal powder is also attempted, bulk material having sufficient strength characteristics such as high strength and high toughness required as a face of a golf club head can not be obtained.

SUMMARY OF THE INVENTION

It is therefore an object of the present invention to provide a golf club head of which face body has excellent strength characteristics and durability, and manufacturing methods with which the golf club head can be easily made.

According to a first aspect of the present invention, a golf club head comprises a face body including an amorphous phase portion and a crystal phase portion. The area of the crystal phase portion is more than 10% of a whole area of the face body observed in a direction at right angles with the face body.

According to a second aspect of the present invention, a golf club head comprises a face body including an amorphous phase layer and a crystal phase layer. The area of the crystal phase layer is more than 10% of a whole area of the face body observed in a direction at right angles with the face body.

According to a third aspect of the present invention, a golf club head comprises a face body including an amorphous phase layer and a crystal phase layer. The thickness of the face body is from 0.5 mm to 5.0 mm. The thickness of the amorphous phase layer is, on average in a whole area of the face body, more than 50% of the thickness of the face body, and the thickness of the crystal phase layer is from 0.01 mm to 3.0 mm.

According to a fourth aspect of the present invention, a golf club head comprises a head main body having a concave portion, and a face body fixed to the concave portion. The face body includes an amorphous phase portion and a crystal phase portion, and the crystal phase portion is disposed along some parts of or entire peripheral rim portion of the face body corresponding to an inner peripheral face of the concave portion.

According to the fifth aspect of the present invention, a golf club head comprises a head main body with a concave portion, and a face body fixed to the concave portion for fitting the face body. The face body includes an amorphous phase portion and a crystal phase portion. The crystal phase portion is disposed along some parts of or entire peripheral rim portion of the face body corresponding to an inner peripheral face of the concave portion. The face body is fixed to the head main body by plastic deformation of the face body and/or the head main body and/or a caulking member at a corresponding position to the crystal phase portion along the peripheral rim portion of the face body.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
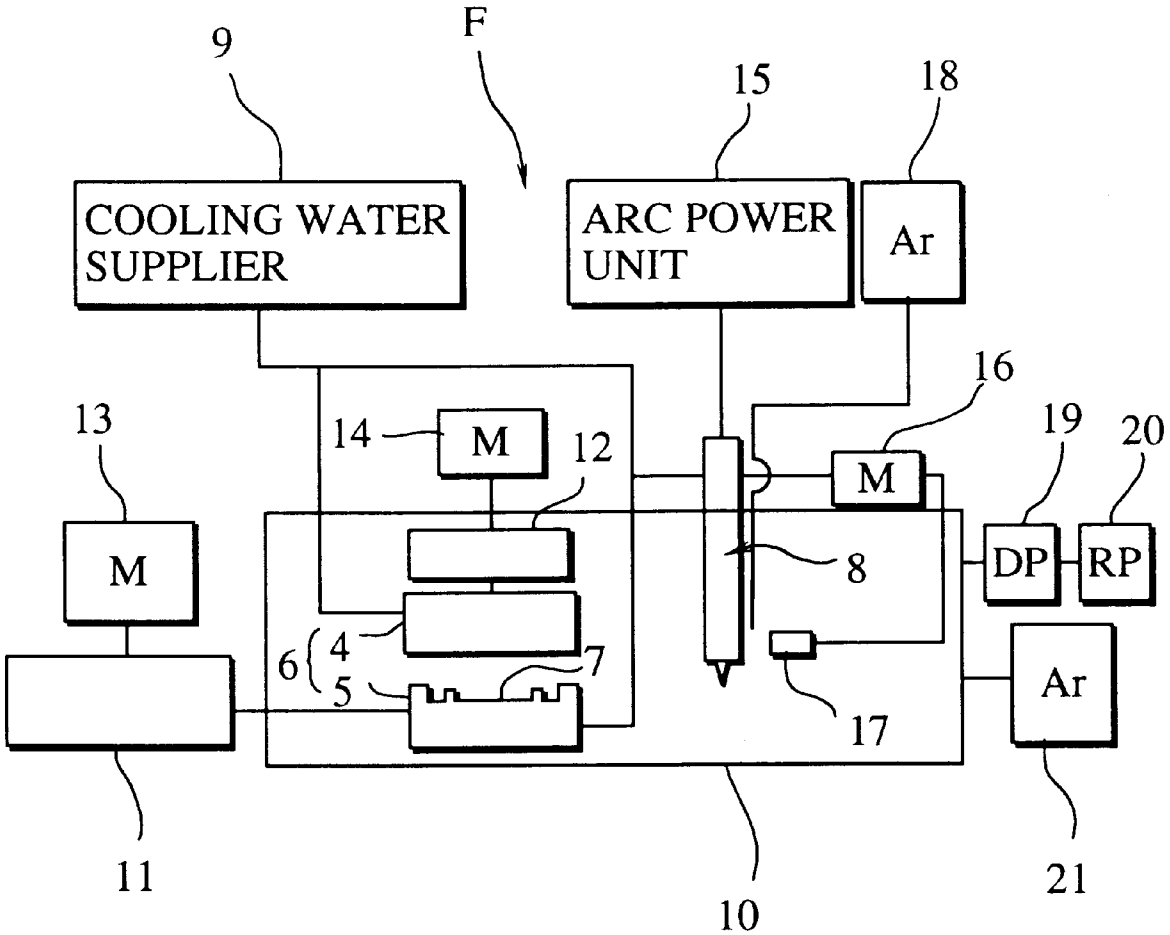
FIG. 1 is an explanatory view of a construction of a manufacturing apparatus which produces a face body for the golf club head of the present invention.

FIG. 1 shows a manufacturing apparatus F which produces a face body 1 for a golf club head of the present invention. The face body 1 produced by this manufacturing apparatus F is composed of a hybrid of an amorphous phase and a crystal phase, and used for a wood type golf club head 2 and an iron type golf club head 3 as shown in FIG. 4 through FIG. 7. And, the golf club of the present invention is characterized by being made with manufacturing methods described below.

First, the manufacturing apparatus F will be described. As shown in FIG. 1, the manufacturing apparatus F is provided with a press metal mold 6 which consists of an upper mold 4 and a lower mold 5, an arc electrode 8 (a tungsten electrode) for melting a metal material placed on a cavity portion 7 of the lower mold 5, a cooling water supplier 9 which circulates and supplies cool water to the upper mold 4 and the lower mold 5 of the press metal mold 6 and the arc electrode 8, a vacuum chamber 10 which contains the press metal mold 6 and the arc electrode 8, a lower mold moving mechanism 11 which is driven by a motor 13 and moves the lower mold 5 in horizontal direction, and an upper mold moving mechanism 12 which is driven by a motor 14 and moves the upper mold 4 in vertical direction.

As the lower mold moving mechanism 11, which is not restrictive, conventional and known translation mechanism and reciprocating mechanism can be used. For example, pneumatic mechanisms such as drive screw and traveling nut with ball screw, air cylinder, etc. and oil pressure mechanisms such as oil hydraulic cylinder, etc. can be appropriately used. And, as the upper mold moving mechanism 12, which is also not restricted, conventional and known press metal mold mechanism such as an oil pressure mechanism and a pneumatic mechanism can be used. Further, other cooling media (refrigerant gas, for example) may be used instead of the cooling water.

The arc electrode 8 is connected with an arc power unit 15, and positioned as to be slightly inclined to a depth of the cavity portion 7 of the lower mold 5, and arranged as to be adjustable in direction of X-axis, Y-axis, and Z-axis by a stepping motor 16. And, to keep a space between the metal material on the lower mold 5 and the arc electrode (in Z-axis direction), movement of the arc electrode 8 may be automatically controlled by the stepping motor 16 with measurement of the position of the metal material by a semiconductor laser sensor 17. Because if the space between the arc electrode 8 and the metal material changes, arc becomes unstable, and instability is generated in fusing temperature. And, an exhaust nozzle of coolant gas (Ar gas, for example) may be arranged near an arc generating portion of the arc electrode 8, the coolant gas is blown out of a gas supplier (a gas cylinder) 18, rapid cooling after heating is promoted.

The vacuum chamber 10 having a water cooling jacket made of SUS is connected with an oil diffusion vacuum pump (a diffusion pump) 19 and an oil rotation vacuum pump (a rotary pump) 20 through a vacuum exhaust port for vacuumization, and connected with a gas supplier (a gas cylinder) 21 through an argon gas leading port for replacement with an inert gas after the vacuumization. And, the cooling water supplier 9 cools down the circulating cooling water with coolant, and supplies the cooling water to the upper mold 4, lower mold 5, and the arc electrode 8.

Figure 2A:
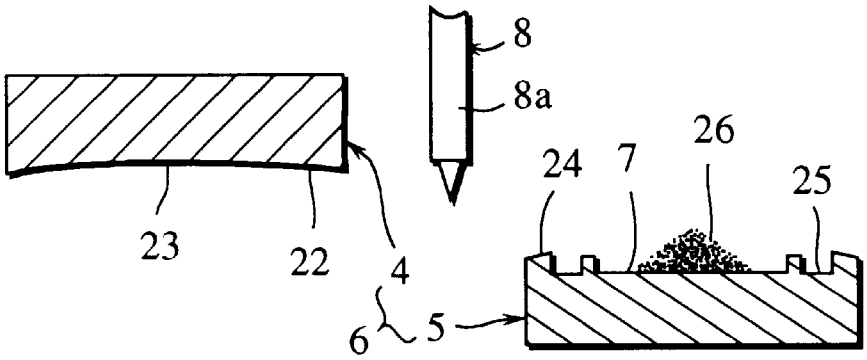
FIG. 2A is a first explanatory view showing a production process of the face body with the manufacturing apparatus.
Figure 2B:
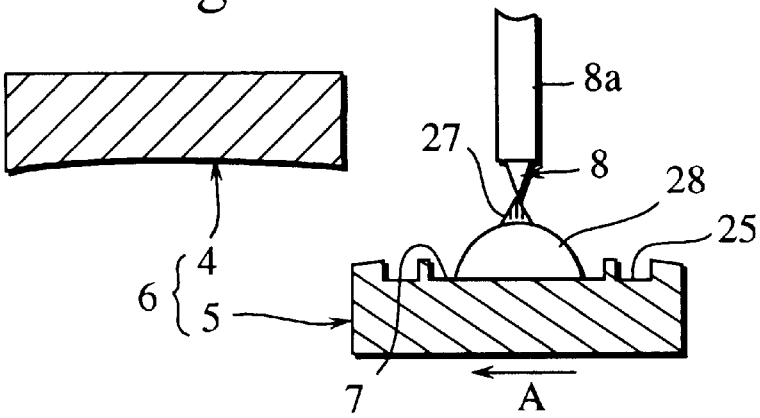
FIG. 2B is a second explanatory view showing the production process of the face body with the manufacturing apparatus.
Figure 2C:
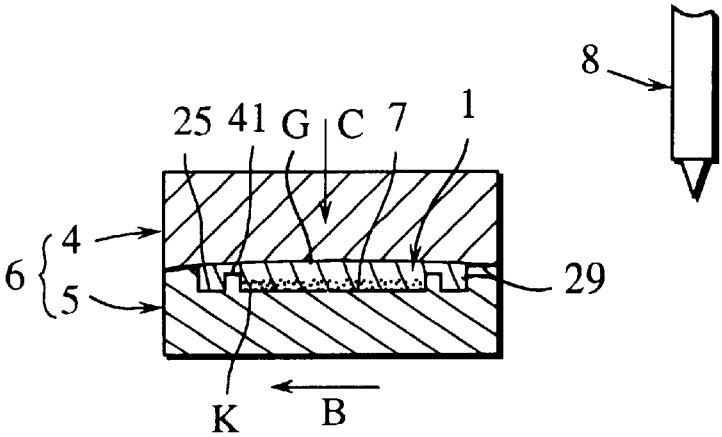
FIG. 2C is a third explanatory view showing the production process of the face body with the manufacturing apparatus.

And, as shown in FIGS. 2A, 2B, and 2C, the press metal mold 6 has a configuration without engagement portions. Concretely, the upper mold 4 has a smooth concave curved face 23, and a part of the concave curved face 23 is a parting face 22.

The lower mold 5 has a parting face 24 of convex curved face superposed on the parting face 22 of the upper mold 4, and a cavity portion 7 of which configuration is plane. And, on a part along the parting face 24 of the lower mold 5, a gap 25 of groove shape and an aperture 41 for connecting the cavity portion 7 and the gap 25 of groove shape in a closed state of the press metal mold (refer to FIG. 2C) are provided. Excessive molten metal in molding flows into the aperture 41, and is absorbed by the gap 25.

Next, a manufacturing method for the molded product of amorphous metal will be described.

First, as shown in FIG. 1 and FIG. 2A, a metal material 26 is placed on the cavity portion 7 of the lower mold 5 set below the upper mold 4. As this metal material 26, ternary system alloys such as Ln(lanthanoids)-Al-TM(transition metals), Mg—Ln-TM, Zr—Al-TM, etc., Zr series alloys such as Zr—Al—Ni—Cu, Zr—Ti—Al—Ni—Cu, Zr—Nb—Al—Ni—Cu, etc., and alloys in which almost all elements may be combined including multinary (over quaternary) system alloys, are used. To facilitate the rapid fusing by a high energy heat source (the arc electrode 8 and the arc power unit 15 in Figures), although it is preferable to use powder or pellet of the alloys, metal material of wire, belt, bar, and lump may be used as far as rapid fusing is possible.

Second, the arc electrode 8 is positioned in X-axis, Y-axis, and Z-axis direction by the laser sensor 17 and the stepping motor 16 through an adapter 8*a*, and the space (distance in Z-axis direction) between the arc electrode 8 and the metal material 26 is set to be a predetermined value.

And, inside of the chamber 10 is made high vacuum, for example, of $5\times10^{-4}$ Pa (using liquid nitrogen trap), with the oil diffusion vacuum pump 19 and the oil rotation vacuum pump 20, then, inside of the chamber 10 is replaced with argon gas by supply of argon gas from the Ar gas supplier 21. And, the upper mold 4, lower mold 5, and the arc electrode 8 are cooled by the cooling water from the cooling water supplier 9.

After the preparation described above, as shown in FIG. 1 and FIGS. 2A and 2B, the lower mold 5 is moved in horizontal direction (a direction shown with an arrow A) by the lower mold moving mechanism 11 driven by the motor 13, and stopped at a position below the arc electrode 8. And, the arc power unit 15 is switched on, plasma arc 27 is generated from a tip end of the arc electrode 8 to the metal material 26, and molten metal 28 is formed by fusing the metal material 26 completely.

Then, as shown in FIG. 1 and FIGS. 2B and 2C, the arc power unit 15 is switched off, and the plasma arc 27 is put off. And, the lower mold 5 is quickly moved (in a direction shown with an arrow B) to a position below the upper mold 4, the upper mold 4 is moved down (in a direction shown with an arrow C) by the upper mold moving mechanism 12 driven by the motor 14, the obtained molten metal 28 of over the melting point is pressed by the upper mold 4 and the lower mold 5 and transformed into a predetermined configuration, and cooled and solidified to obtain a face body 1 in the predetermined configuration.

In this process, a bottom side of the metal material 26 touching the cavity portion 7 is not completely fused for the heat is absorbed by the lower mold 5, a part touching the cavity portion 7 (the above-mentioned bottom side) remains as a crystal phase K after the press molding (transformation) without forming an amorphous phase. And, another part of the molten metal 28 completely fused and raising on the cavity portion 7 is, simultaneously with or after the transformation by the press molding, cooled at over a critical cooling rate, and becomes an amorphous phase G. By this process, the face body 1 composed of the amorphous phase G (an amorphous phase layer G') and the crystal phase K (a crystal phase layer K') is formed.

Figure 3A:
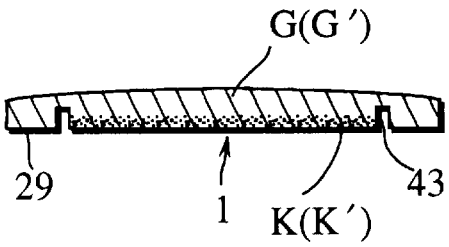
FIG. 3A is a cross-sectional view showing the molded face body before finishing.
Figure 3B:
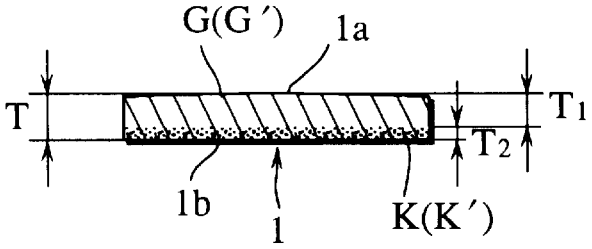
FIG. 3B is a cross-sectional view showing the molded face body after finishing.

FIG. 3A shows the face body 1 (partially fabricated item) taken out of the press metal mold 6. This face body has flash 29 formed by cooling solidification of the excessive molten metal, and is finished with cutting and grinding to remove the flash 29 as shown in FIG. 3B.

This fully produced face body 1 in a final configuration has a smooth convex curved face on the amorphous phase layer G' side, this convex curved face is a face 1*a*, and the crystal phase layer K' is disposed on a reverse face 1*b* side which is opposite to the face 1*a*. And, area of the crystal phase K occupies more than 10% of the reverse face 1*b* observed in a direction at right angle with the face body 1. That is to say, more than 10% of the whole area of the reverse face 1*b* of the face body 1 is the crystal phase layer K', and the crystal phase layer K' occupies 100% of the reverse face 1*b* in the case of the face body 1 shown in FIG. 3B. Further, thickness of the amorphous phase layer G' (thickness dimension $T_1$) is, on average in whole area of the face body 1, more than 50% of thickness of the face body 1 (thickness dimension T), and thickness of the crystal phase layer K' (thickness dimension $T_2$) is arranged to be 0.01 mm to 3.0 mm. More preferably, the thickness dimension $T_2$ is 0.05 mm to 0.3 mm. The face body 1 becomes excellent in strength characteristics and durability by having above-described conditions, and this will be described later in detail.

Figure 4:
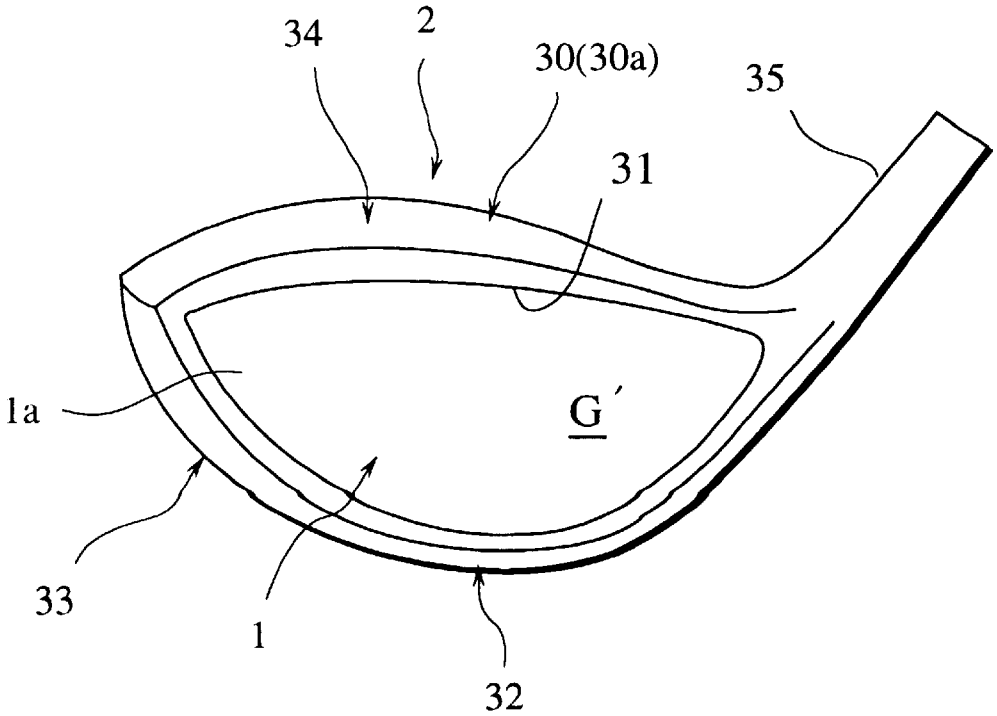
FIG. 4 is a front view showing first preferred embodiment of the golf club head of the present invention.
Figure 5:
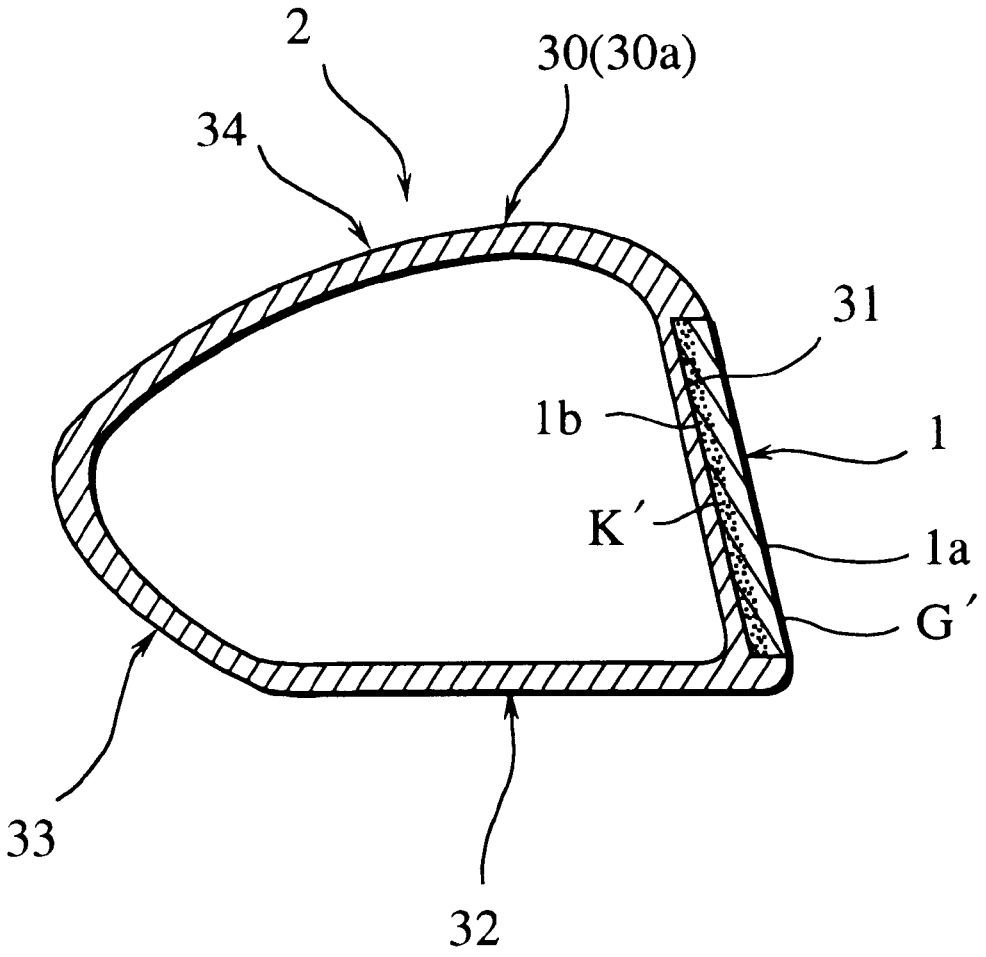
FIG. 5 is a cross-sectional side view showing the first preferred embodiment of the golf club head of the present invention.

FIG. 4 and FIG. 5 show a hollow wood type golf club head (metal head) 2 made with the fully produced face body 1 in the final configuration (first preferred embodiment). Concretely, this club head 2 consists of a head main body 30 (30*a*) made of titanium, titanium alloy, stainless steel etc. and the face body 1 fitted to a concave portion for fitting 31 formed on the face 1*a* side of the head main body 30 (30*a*), 32 is a sole, 33 is a side portion, 34 is a crown portion, and 35 is a neck portion. The face body 1 made of amorphous metal is fitted to the concave portion for fitting 31 of the head main body 30 (30*a*), and fixed with adhesive, welding, caulking, press fitting (when the face body 1 is fitted), etc.

Figure 6:
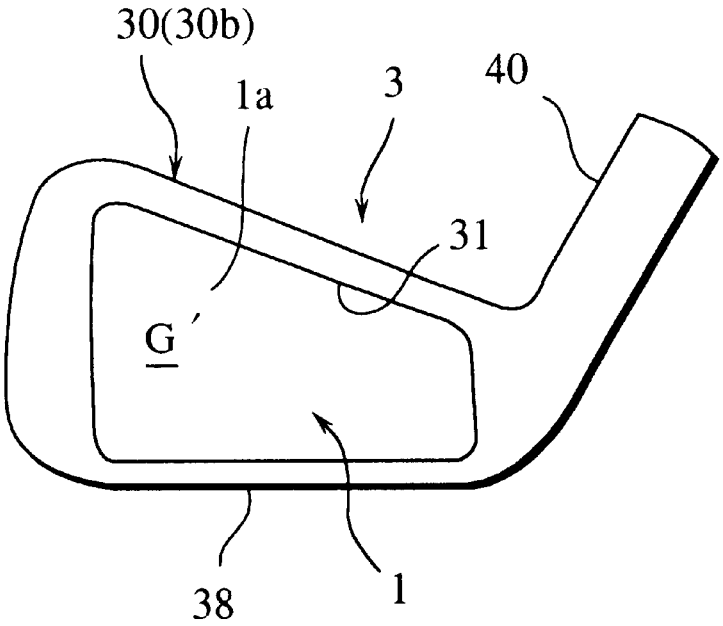
FIG. 6 is a front view showing second preferred embodiment of the golf club head.
Figure 7:
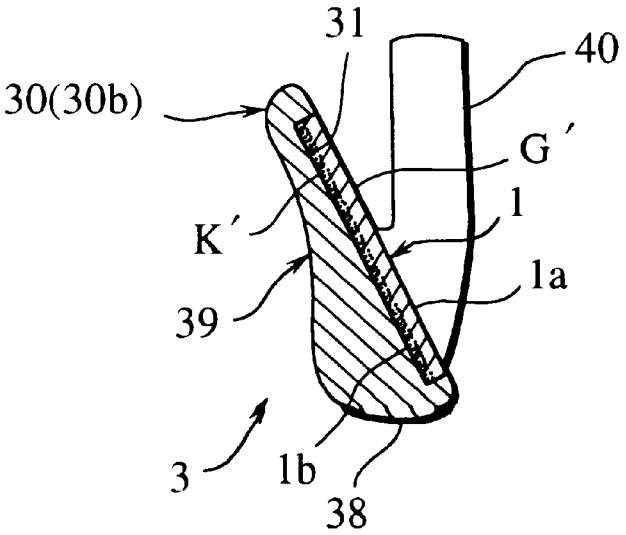
FIG. 7 is a cross-sectional side view showing the second preferred embodiment of the golf club head.

And, FIG. 6 and FIG. 7 show an iron type golf club head 3 made with the fully produced face body 1 in the final configuration (second preferred embodiment). This club head 3 consists of a head main body 30 (30*b*) made of titanium, titanium alloy, stainless steel etc. and the face body 1 fitted to a concave portion for fitting 31 formed on the face 1*a* side of the head main body 30 (30*b*), 38 is a sole, 39 is a back face, and 40 is a neck portion. The face body 1 is (same as the above description) fitted to the concave portion for fitting 31 of the head main body 30 (30*b*), and fixed with adhesive, welding, caulking, press fitting (when the face body 1 is fitted), etc.

A golf club head of the present invention can keep stable repeatability in ball hittings, and consequently, demonstrate excellent characteristics such as long flying distance, directionality, impact characteristics, strength, toughness, etc. by using the face body 1 obtained as described above (a face body having the set conditions described with reference to FIGS. 3A and 3B). And, rigidity of the face body 1 is increased by utilizing that elastic modulus of the crystal phase K is higher than that of the amorphous phase G and disposing the crystal phase K intentionally on the reverse face 1*b* side, and deformation amount of the face body 1 is reduced thereby.

In the set conditions of the face body 1, if the area of the crystal phase K is less than 10% of the whole area of the reverse face 1*b*, or the thickness of the crystal phase layer K' is less than 0.05 mm, deformation preventive effect of the face body 1 is not observed. And, if the thickness of the crystal phase layer K' is more than 3.0 mm, production of the face body 1 becomes difficult or impossible for the excessive thickness of the face body 1 itself. And, if the thickness of the amorphous phase layer G' is less than 50% of the thickness of the face body 1, problems are generated in strength characteristics.

Figure 8:
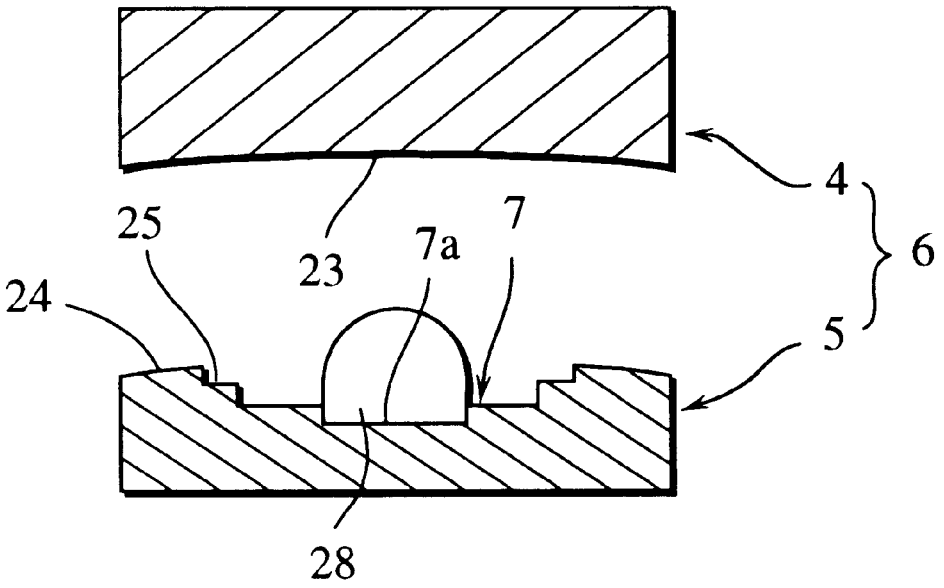
FIG. 8 is a cross-sectional front view showing a state before closing of a press metal mold.
Figure 10:
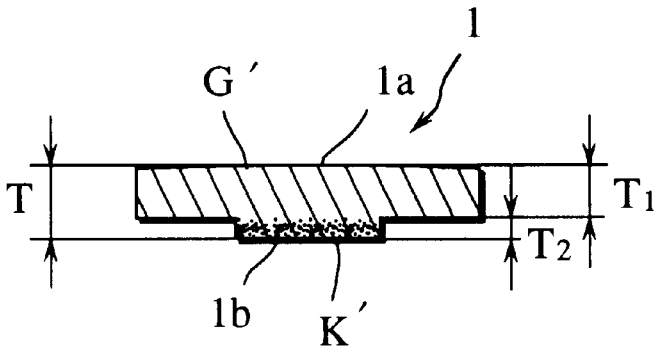
FIG. 10 is a cross-sectional view showing the face body in final configuration.
Figure 11:
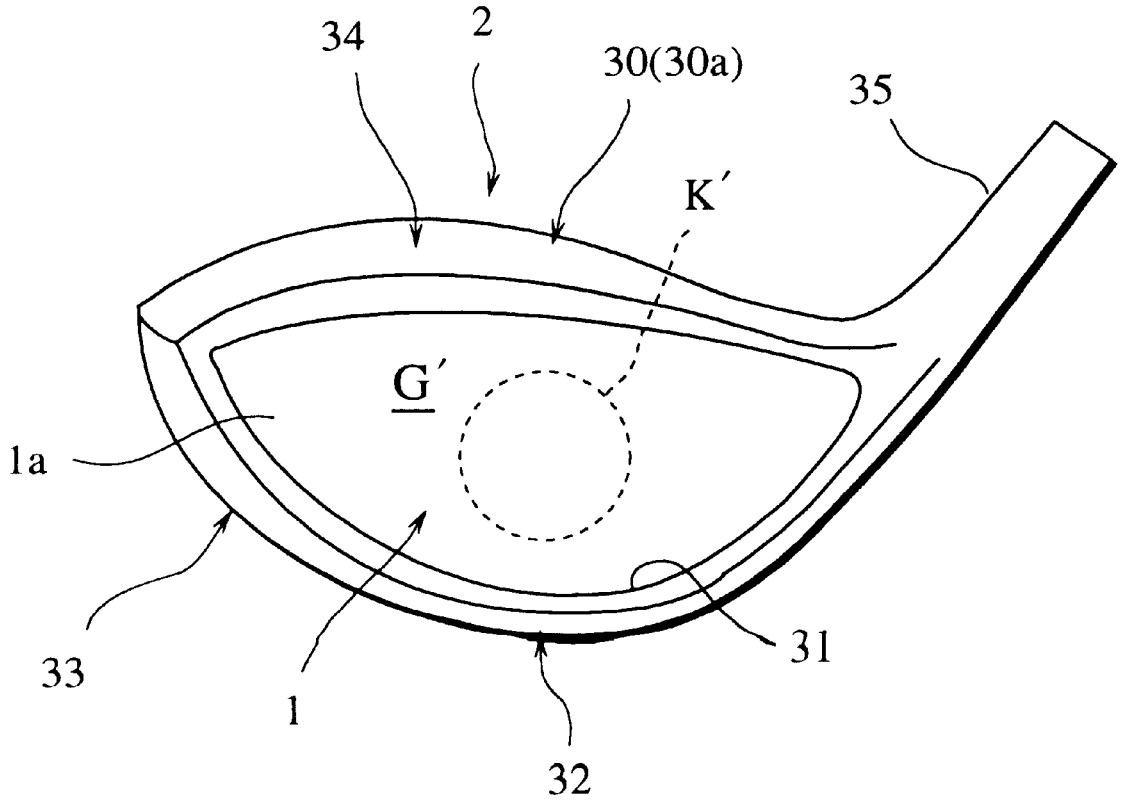
FIG. 11 is a front view showing third preferred embodiment of the golf club head.

Next, FIG. 10 and FIG. 11 shows a face body 1 consists of the amorphous phase layer G' and the crystal phase layer K' in which the crystal phase layer K' is disposed on a part of the reverse face 1*b* side of the face body 1. And, this face body 1 is, as shown in FIG. 8, formed by a press metal mold 6 which consists of an upper mold 4 having a concave curved face 23 and a lower mold 5 having a cavity portion 7 and a circular concave portion 7*a* on the cavity portion 7. And, 25 is a gap formed along a parting face 24 of the lower mold 5.

Figure 9:
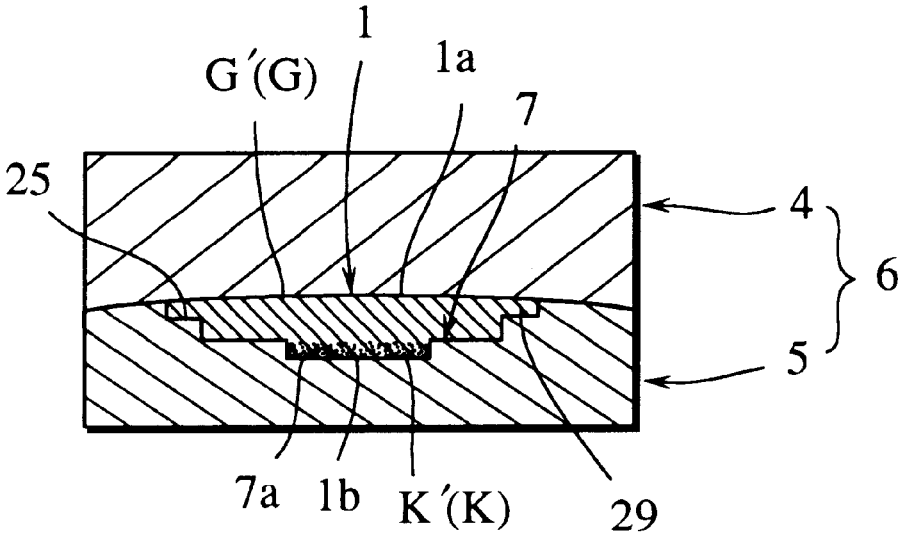
FIG. 9 is a cross-sectional front view showing a closed state of the press metal mold.

In case of this press metal mold 6, the metal material 26 is placed on the concave portion 7*a* of the cavity portion 7 (as described with reference to FIGS. 2A, 2B, and 2C) and fused. Then, as shown in FIG. 8, the obtained molten metal 28 over the melting point stays on the concave portion Ta (kept spherical by its surface tension) as shown in FIG. 8. And, as shown in FIG. 8 and FIG. 9, the upper mold 4 is descended and pressed, the molten metal 28 is transformed in a predetermined configuration, and the face body 1 is formed with cooling solidification. In this process, a part of the molten metal 28 raising on the concave portion 7*a* of the cavity portion 7 (a part completely fused) is rapidly cooled at over the critical cooling rate, and becomes the amorphous phase layer G' (the amorphous phase G). And, lower portion of the molten metal 28 touching the concave portion 7*a* (staying on the concave portion 7*a*) becomes the crystal phase layer K' (the crystal phase K) because it is not completely fused for the lower mold 5 absorbs heat. It is preferable that the lower mold 5 is kept under 50° C. by a water-cooling apparatus, etc. to absorb the heat with the lower mold 5.

And, as shown in FIG. 10 and FIG. 11, the face body 1 is taken out of the metal mold after the molding, the flash 29 is removed, and the face body 1 of the final configuration which consists of the plate-shaped amorphous phase layer G' and the circular crystal phase layer K' protruding from the reverse face 1*b* side of the amorphous phase layer G' is obtained. That is to say, the crystal phase layer K' is disposed as to reinforce approximately central portion of the face 1*a* which is most greatly deformed by hitting impact. Also in case of this face body 1, area of the crystal phase K (the crystal phase layer K') occupies more than 10% of the whole area of the reverse face 1*b*. And, the thickness dimension $T_1$ of the amorphous phase layer G' is, on average in whole area of the face body 1, more than 50% of the thickness dimension T of the face body 1, and the thickness dimension $T_2$ of the crystal phase layer K' is arranged to be 0.05 mm to 3.0 mm.

Figure 12:
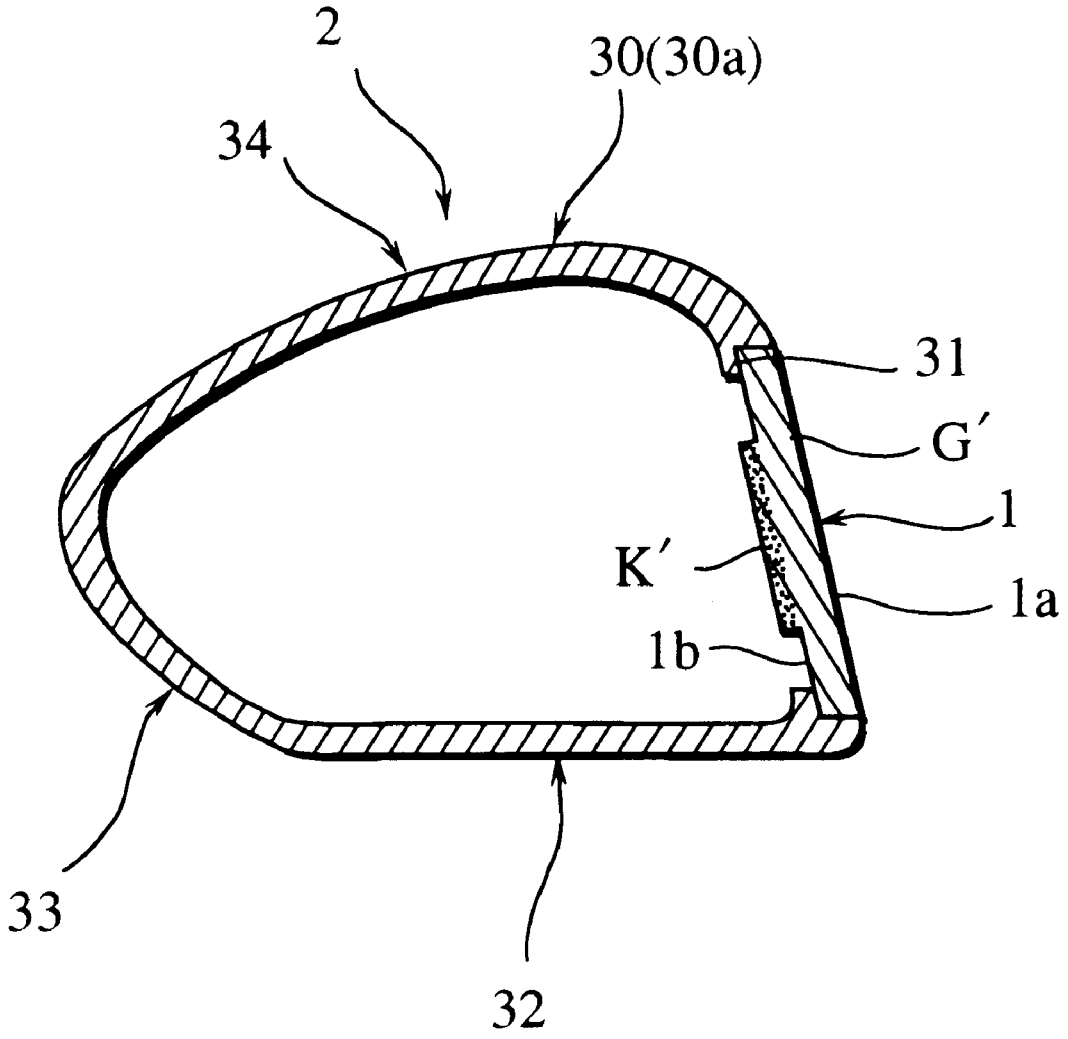
FIG. 12 is a cross-sectional side view showing the third preferred embodiment of the golf club head.

FIG. 11 and FIG. 12 show an wood type golf club head 2 made with the fully produced face body 1 in the final configuration (third preferred embodiment). In this club head 2, the face body 1 is fitted to the concave portion for fitting 31 of the head main body 30 (30*b*) having an opening, and fixed with adhesive, welding, caulking, press fitting (when the face body 1 is fitted), etc.

Figure 13:
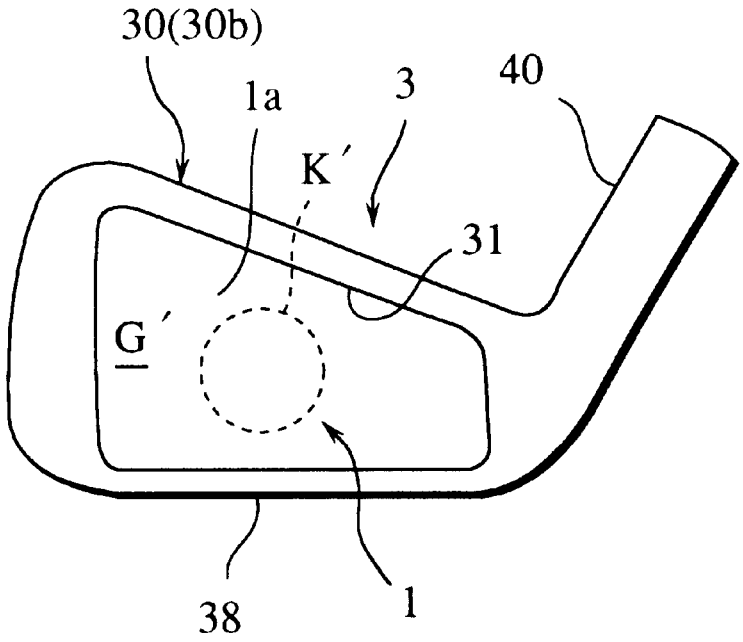
FIG. 13 is a front view showing fourth preferred embodiment of the golf club head.
Figure 14:
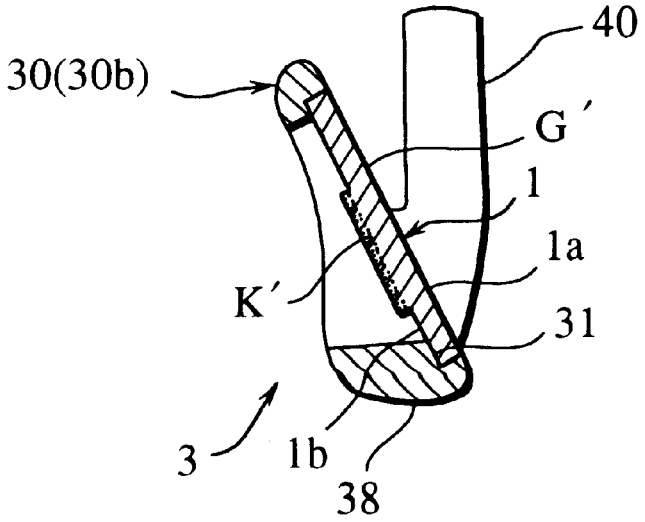
FIG. 14 is a cross-sectional side view showing the fourth preferred embodiment of the golf club head.

And, FIG. 13 and FIG. 14 show an iron type golf club head 3 made with the fully produced face body 1 in the final configuration (fourth preferred embodiment). Also in this club head 3, the face body 1 is fitted to the concave portion for fitting 31 of the head main body 30 (30*b*) having an opening, and fixed with adhesive, welding, caulking, press fitting (when the face body 1 is fitted), etc. A back face is omitted in FIGS. 13 and 14.

Figure 17:
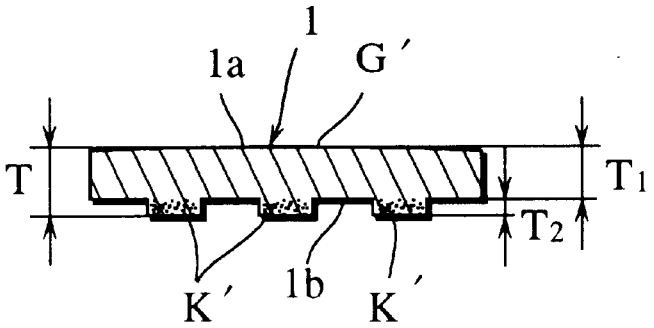
FIG. 17 is a cross-sectional view showing the face body in final configuration.
Figure 18:
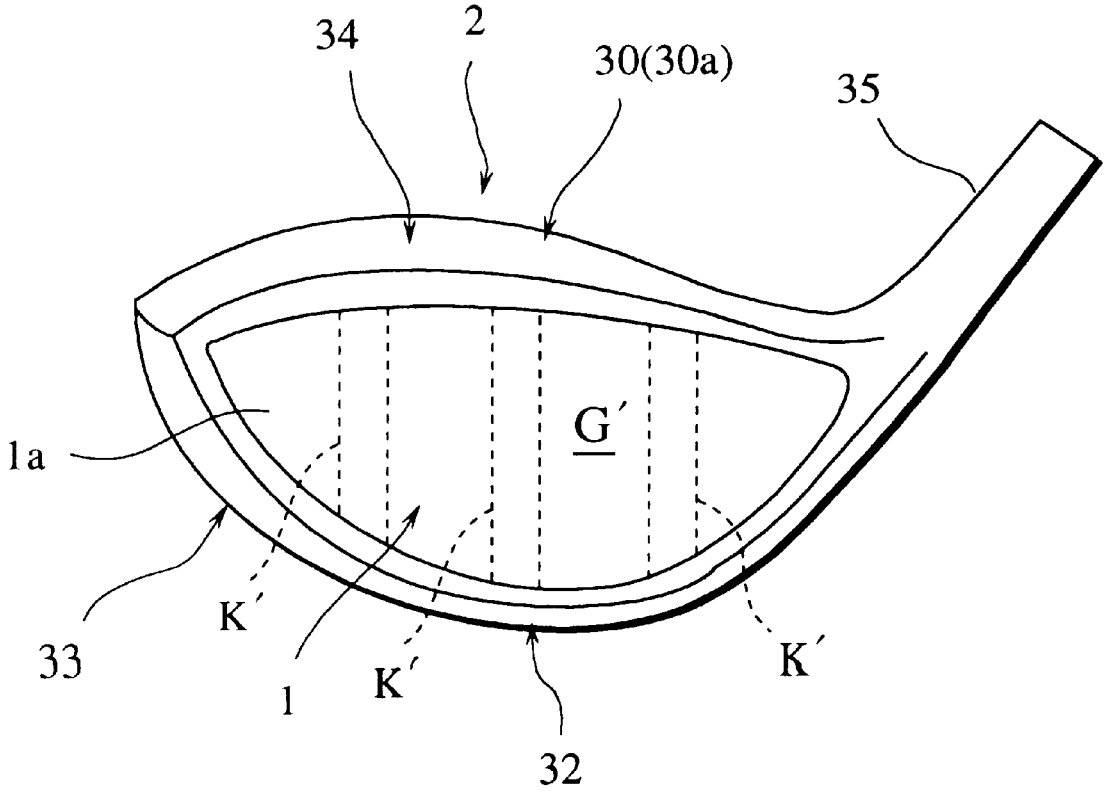
FIG. 18 is a front view showing fifth preferred embodiment of the golf club head.

Next, FIG. 17 and FIG. 18 show a face body 1 consists of the amorphous phase layer G' and the crystal phase layer K'. The crystal phase layers K' are disposed on the reverse face side 1*b* of the face body 1 as to be vertical stripes, and these plural crystal phase layers K' are ribs.

Figure 15:
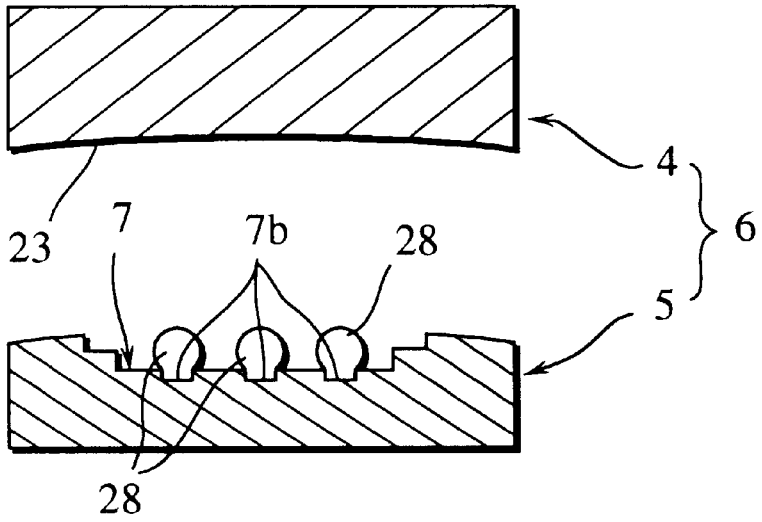
FIG. 15 is a cross-sectional front view showing a state before closing of a press metal mold.
Figure 16:
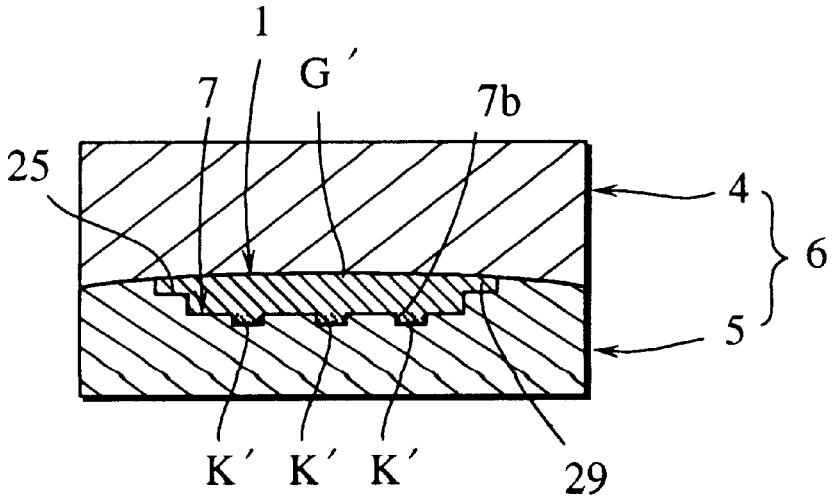
FIG. 16 is a cross-sectional front view showing a closed state of the press metal mold.

Accordingly, as shown in FIG. 15, plural concave grooves 7*b* of the same depth dimension and width dimension are disposed on the cavity portion 7 of the lower mold 5, with which the face body 1 is made, with a predetermined interval. When metal material is placed and fused on each concave groove 7*b* on the cavity portion 7, obtained molten metal 28 raises on the each concave groove 7*b*. And, as shown in FIG. 15 and FIG. 16, the upper mold 4 is descended and pressed, the molten metal 28 is transformed into a predetermined configuration and solidified by cooling, and the face body 1 is formed thereby. In this process, a raising part of the molten metal 28 on each concave groove 7*b* of the cavity portion 7 becomes the amorphous phase layer G' by rapid cooling at over the critical cooling rate, and a lower part (bottom face side) of the molten metal 28 touching the concave groove 7*b* (staying in each concave groove 7*b*) becomes the crystal phase layer K' after the molding because not completely fused for heat absorption by the lower mold 5.

And, as shown in FIG. 17 and FIG. 18, the face body 1 in the final configuration that consists of the plate-shaped amorphous phase layer G' and the plural crystal phase layers K' as vertical belts protruding from the reverse face 1*b* side of the amorphous phase layer G' is obtained. In case of this face body 1, rigidity of the face body 1 is increased by that the crystal phase layers K' are disposed on the face body 1 as to be a structure of plural ribs. Further, also in case of this face body 1, area of the crystal phase layers K' occupies more than 10% of the whole area observed in a direction at right angles with the face body 1. And, the thickness dimension $T_1$ of the amorphous phase layer G' is, on average in whole area of the face body 1, more than 50% of the thickness dimension T of the face body 1, and the thickness dimension $T_2$ of the crystal phase layer K' is arranged to be 0.05 mm to 3.0 mm.

Figure 19:
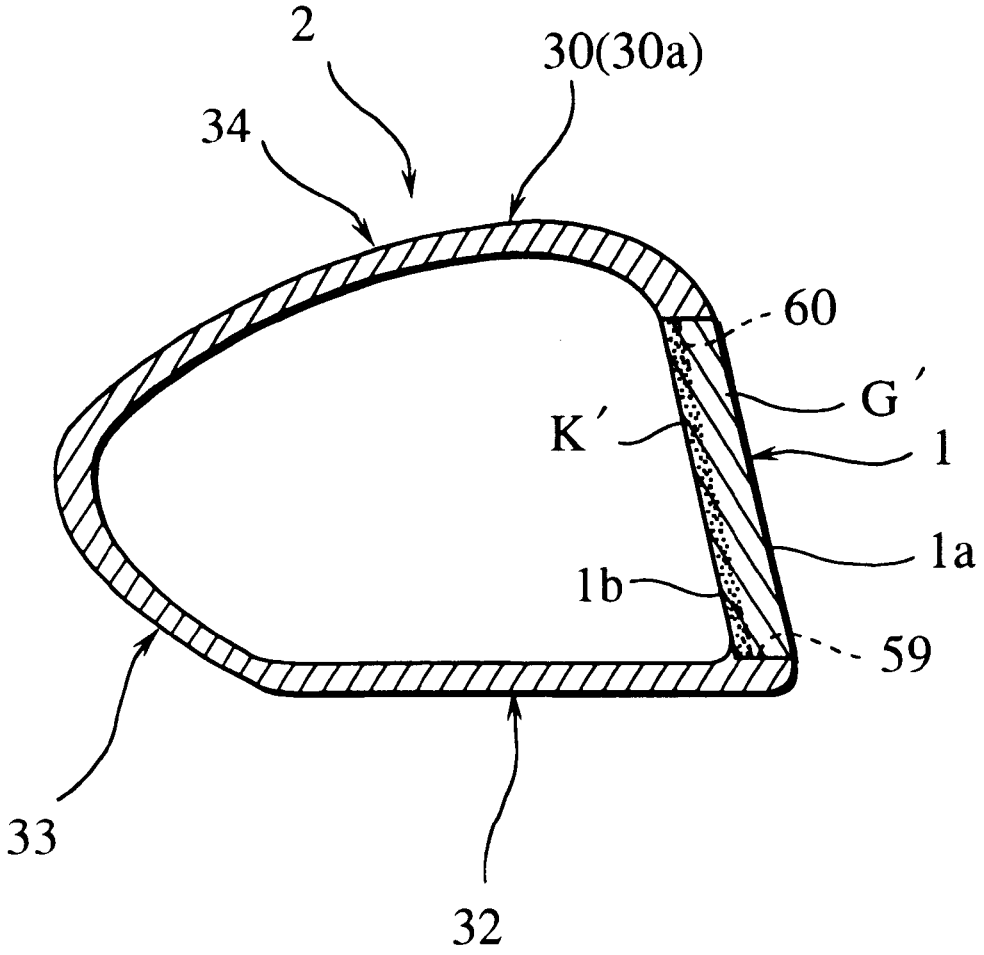
FIG. 19 is a cross-sectional side view showing the fifth preferred embodiment of the golf club head.

FIG. 18 and FIG. 19 show a wood type golf club head 2 made with the fully produced face body 1 in the final configuration (fifth preferred embodiment). In this club head 2, the face body 1 is fitted to the hole portion for fitting 59 of the head main body 30 (30*a*), and the reverse face 1*b* of the face body 1 (the reverse face 1*b* of the amorphous phase layer G')is fixed with adhesive, welding, caulking, press fitting (when the face body 1 is fitted), etc. to an attachment piece 60 formed on peripheral rim of the hole portion 59.

Figure 20:
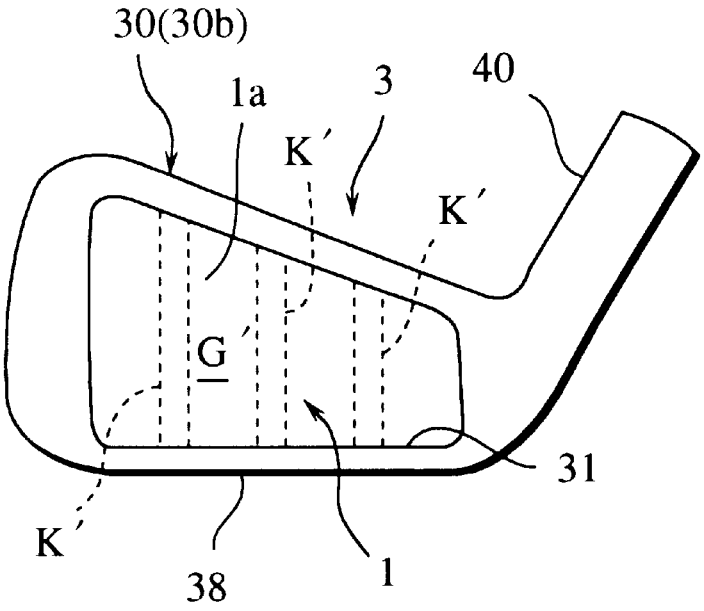
FIG. 20 is a front view showing sixth preferred embodiment of the golf club head.
Figure 21:
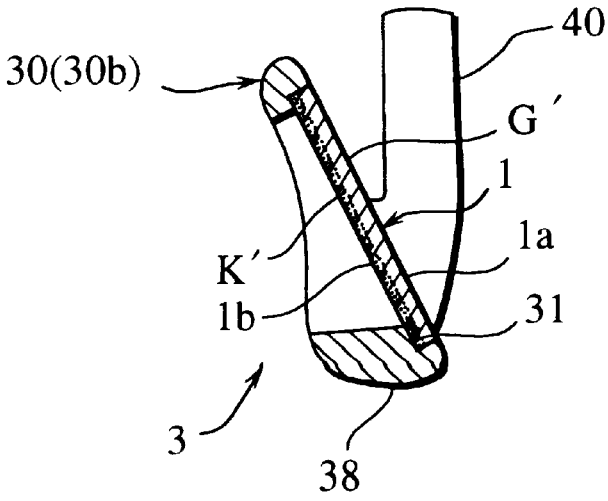
FIG. 21 is a cross-sectional side view showing the sixth preferred embodiment of the golf club head.

And, FIG. 20 and FIG. 21 show an iron type golf club head 3 made with the fully produced face body 1 in the final configuration (sixth preferred embodiment). In this club head 3, the face body 1 is fitted to the concave portion for fitting 31 of the head main body 30 (30*b*) having an opening, and fixed with adhesive, welding, caulking, press fitting (when the face body 1 is fitted), etc. And, the club head 3 has a groove portion on a part of the concave portion for fitting 31 which fits to the crystal phase layers K'.

Next, another manufacturing method for a golf club head of the present invention will be described.

Figure 22A:
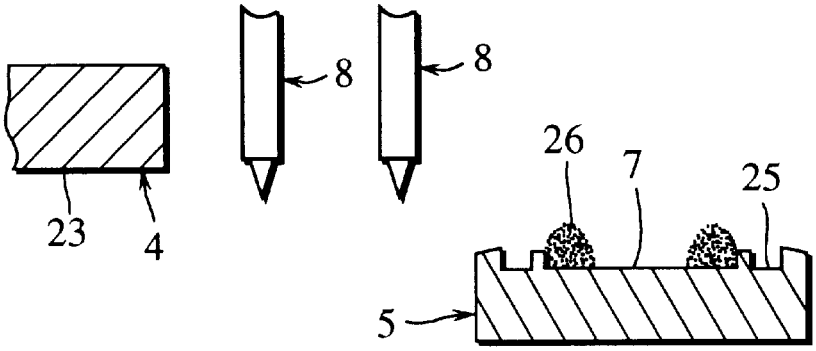
FIG. 22A is a first explanatory view showing a production process of another face body with the manufacturing apparatus.
Figure 22B:
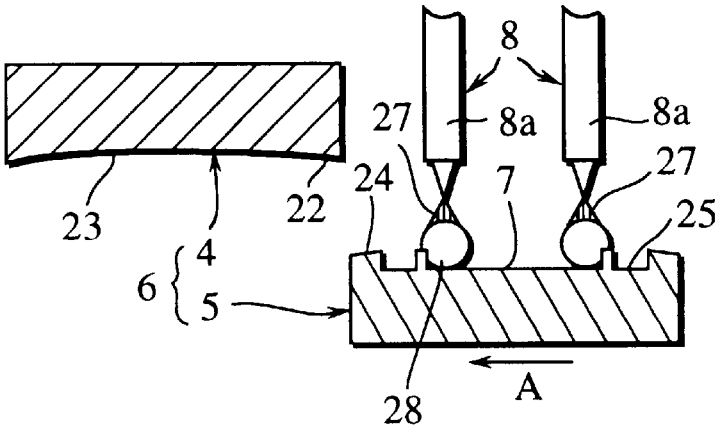
FIG. 22B is a second explanatory view showing the production process of another face body with the manufacturing apparatus.

First, as shown in FIG. 1 and FIG. 22A, metal material 26 is placed on a predetermined position on the cavity portion 7 of the lower mold 5 (as to be a loop along a side wall of the cavity portion 7). And, as shown in FIG. 1 and FIG. 22B, the lower mold 5 is moved in a horizontal direction (a direction shown with an arrow A) by a lower mold moving mechanism 11 driven by a motor 13 and stopped at a position below arc electrodes 8. The plural arc electrodes 8 are, in this case, disposed on positions corresponding to the metal material 26 placed as a loop for fusing the metal material 26 totally and rapidly.

And, an arc power unit 15 is switched on,plasma arc 27 is generated from a tip end of each arc electrode 8 to the metal material 26, and molten metal 28 is formed by fusing the metal material 26 completely. In this process, the molten metal 28 raises as a loop along the side wall of the cavity portion 7.

Figure 22C:
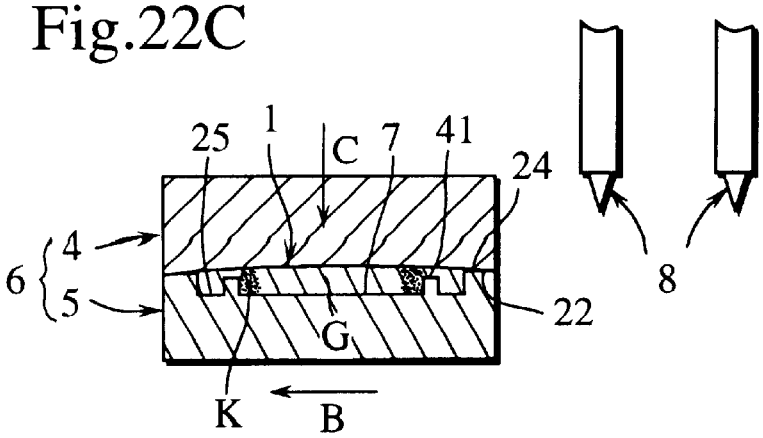
FIG. 22C is a third explanatory view showing the production process of another face body with the manufacturing apparatus.

Then, as shown in FIG. 1 and FIGS. 22B and 22C, the arc power unit 15 is switched off, and the plasma arc 27 is put off. And, the lower mold 5 is quickly moved (in a direction shown with an arrow B) to a position below the upper mold 4, the upper mold 4 is moved down (in a direction shown with an arrow C) by the upper mold moving mechanism 12 driven by the motor 14, the obtained molten metal 28 of over the melting point is pressed by the upper mold 4 and the lower mold 5 and transformed into a predetermined configuration, and cooled and solidified to obtain a face body 1 in the predetermined configuration.

In this process, a bottom side and a lateral side of the metal material 26 touching the cavity portion 7 are not completely fused for the heat is absorbed by the lower mold 5, a part touching the cavity portion 7 (the above-mentioned bottom side and lateral side) remains as a crystal phase K after the press molding (transformation) without forming an amorphous phase. And, another part of the molten metal 28 completely fused and raising on the cavity portion T is, simultaneously with or after the transformation by the press metal mold, cooled at over a critical cooling rate, and becomes an amorphous phase G.

In other words, most or whole part of the metal material 26 on the cavity portion 7 of the lower mold 5 is fused, the obtained molten metal 28 is transformed by the press metal mold 6, the amorphous phase G is formed on a main portion of the face body 1 by cooling most or whole part of the molten metal 28 at over the critical cooling rate simultaneously with or after the transformation, and the crystal phase K is formed along whole periphery within a range corresponding to a peripheral rim portion of the face body 1. The face body 1 consists of a hybrid of the amorphous phase G and the crystal phase K is formed thereby. And, to take the heat from a part of the metal material 26 sufficiently, when the metal material 26 is fused, it is preferable to keep the lower mold 5 under 50° C. with a water cooling apparatus, etc.

Figure 23A:
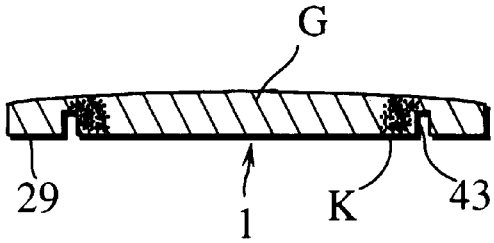
FIG. 23A is a cross-sectional view showing the molded face body before finishing.
Figure 23B:
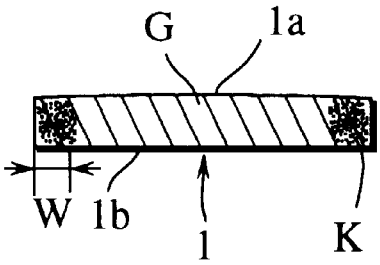
FIG. 23B is a cross-sectional view showing the molded face body after finishing.

FIG. 23A shows the face body 1 (partially fabricated item) taken out of the press metal mold 6. This face body has flash 29 formed by cooling solidification of the excessive molten metal on its peripheral rim 43, and is finished with cutting and grinding to remove the flash 29 as shown in FIG. 23B.

Figure 24:
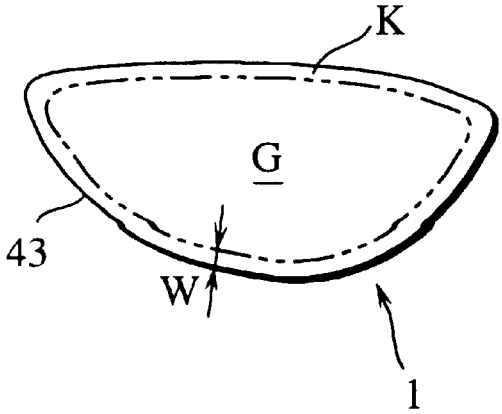
FIG. 24 is a front view of a face body for a wood type golf club head.

The face body 1 in the final configuration formed and fully produced as described above has a smooth convex curved face, and this convex curved face is a face 1*a*. And, as shown in FIG. 23B and FIG. 24, in this face body 1 (for a wood type golf club), the above-mentioned crystal phase K is disposed along the whole peripheral rim portion (between the peripheral rim 43 and an imaginary line), the amorphous phase G is disposed on the main portion inner to the crystal phase K. In this case, volume of the crystal phase K is less than 50% of volume of the face body 1, and width dimension W of the crystal phase K (a dimension between the peripheral rim and the imaginary line) is arranged to be 0.5 mm to 5 mm. The face body 1 becomes excellent in strength characteristics, and caulk fitting to a head main body (described later) becomes easy by being provided with the conditions above.

Figure 25:
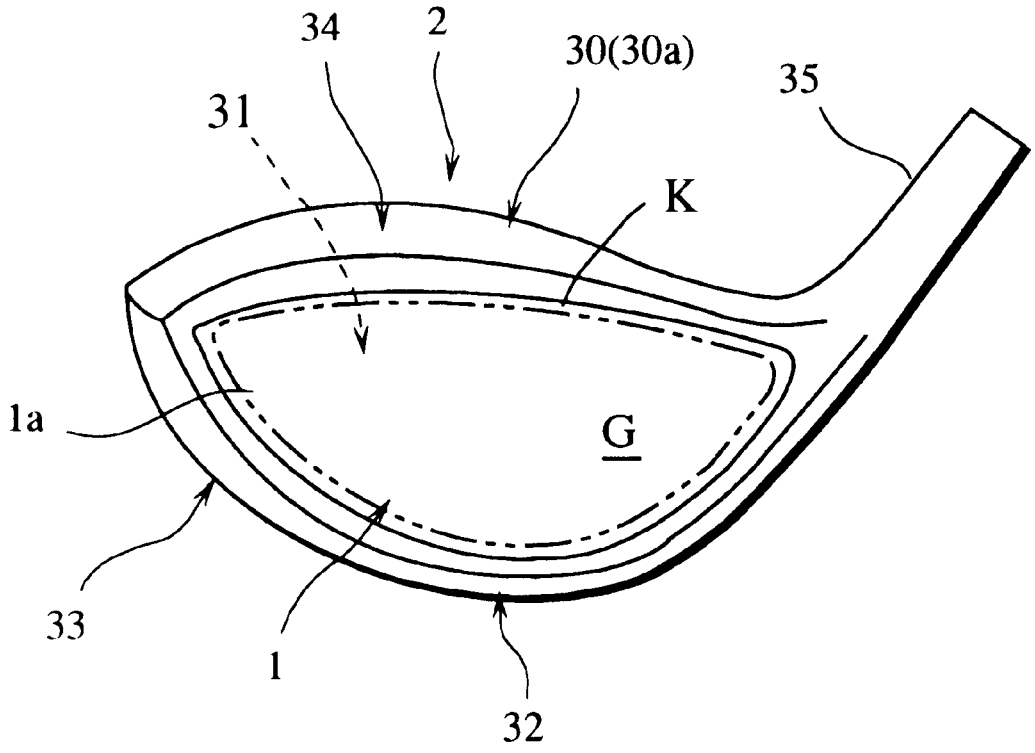
FIG. 25 is a front view showing seventh preferred embodiment of the golf club head of the present invention.
Figure 26A:
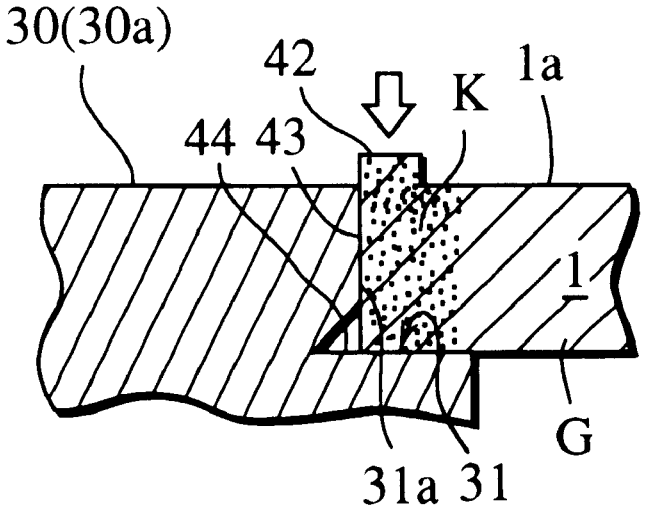
FIG. 26A is a cross-sectional explanatory view of an enlarged principal portion before plastic deformation.
Figure 26B:
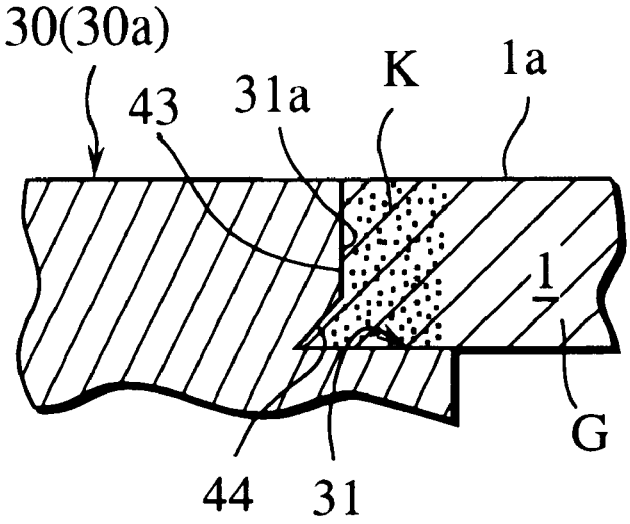
FIG. 26B is a cross-sectional explanatory view of the enlarged principal portion after the plastic deformation.

FIG. 25 and FIGS. 26A and 26B show a hollow wood type golf club head (metal head) 2 made with the fully produced face body 1 in the final configuration (seventh preferred embodiment). Concretely, this club head 2 consists of a head main body 30 (30*a*) made of titanium, titanium alloy, stainless steel etc. having a concave portion for fitting 31 formed on the face 1*a* side and the face body 1 having the peripheral rim portion corresponding to an inner peripheral face 31*a* of the concave portion for fitting 31, 32 is a sole, 33 is a side portion, 34 is a crown portion, and 35 is a neck portion.

A method for fixing the face body 1 to the head main body 30 (30*a*) will be described here. In this method, as shown in FIG. 25 and FIG. 26B, the face body 1 is fitted to the concave portion for fitting 31, and the face body 1 is fixed to the head main body 30 by plastic deformation at a position corresponding to the crystal phase K on the peripheral rim portion of the face body 1.

That is to say, the method uses plastic deformability of the crystal phase K. In this case, for example, a protruding portion 42 of the crystal phase is formed along the whole peripheral rim 43 on the face 1*a* side of the face body 1 (in the press molding), and a concave portion 44 to absorb the plastically deformed crystal phase K along a whole corner portion of the concave portion for fitting 31 of the head main body 30. The protruding portion 42 may be arranged partially along the peripheral rim 43, and the concave portion 44 may be arranged on positions corresponding to the protruding portion 42.

And, as shown in FIG. 26B, reverse side of the crystal phase K gets into the concave portion 44 with plastic deformation of the crystal phase K by pressing the protruding portion 42 (in a direction shown with an arrow) with a press machine, etc. to make the face 1*a* smooth. Therefore, the face body 1 can be fixed to the head main body 30 without damage (the amorphous phase G is not damaged). And, when the face body 1 is pressed by the press machine, etc., the face body 1 does not dislocate because the peripheral rim 43 of the face body 1 contacts the inner peripheral face 31*a* of the concave portion 31. Then, needless protruding part is removed by finishing work such as grinding on the face 1*a* side, and the club head becomes a state of finished product (as shown in FIG. 26B).

A golf club head of the present invention can keep stable repeatability in ball hittings, and consequently, demonstrate excellent characteristics such as long flying distance, directionality, impact characteristics, strength, toughness, etc. by using the face body 1 obtained as described above. And, the face body 1 can be easily caulk-fitted (connected) to the head main body 30 with plastic deformation of the face body 1 for that the crystal phase K relatively plastically deformable is intentionally disposed on the peripheral rim portion of the face body 1. Further, set conditions of the crystal phase K in the face body 1 described with reference to FIGS. 23A and 23B and FIG. 24, namely, the volume of the crystal phase K is less than 50% of the volume of the face body 1 and the width dimension W is 0.5 mm to 5 mm, is optimum for both of function and production of the golf club head.

Figure 27A:
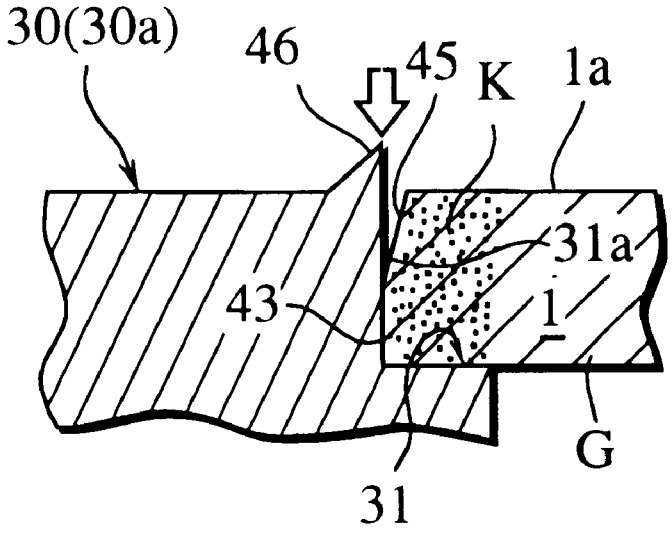
FIG. 27A is a cross-sectional explanatory view of an enlarged principal portion before plastic deformation showing eighth preferred embodiment of the golf club head.
Figure 27B:
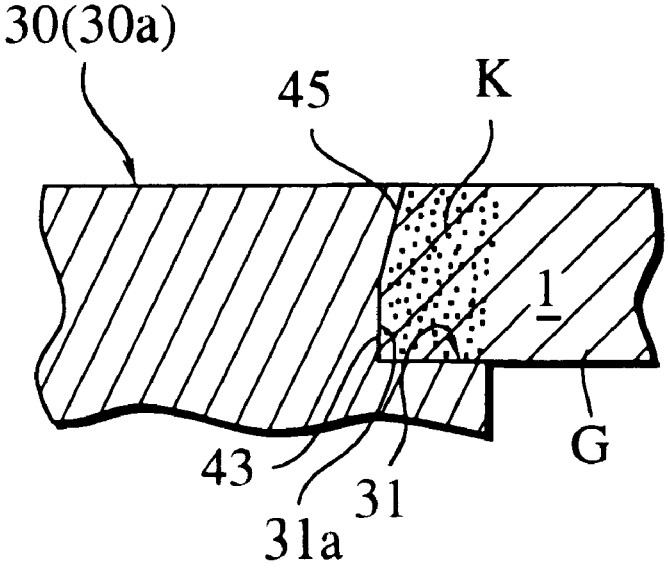
FIG. 27B is a cross-sectional explanatory view of the enlarged principal portion after the plastic deformation showing eighth preferred embodiment of the golf club head.
Figure 28:
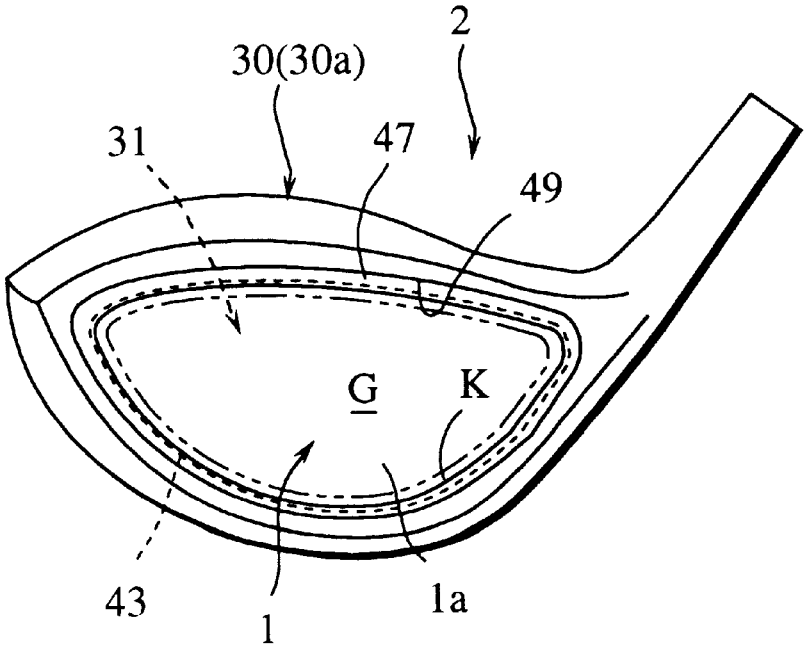
FIG. 28 is a front view showing ninth preferred embodiment of the golf club head.

Next, FIGS. 27A and 27B show a case that the face body 1 is fixed to the head main body 30 (30*a*) by plastic deformation of the head main body 30 (30*a*) (eighth preferred embodiment). Concretely, as shown in FIG. 27A, a chamfer 45 is provided along the whole (or some parts of) peripheral rim 43 on the face 1*a* side of the face body 1, and a protruding portion 46 is provided along a whole (or some parts of) opening edge on the face 1*a* side of the concave portion 31 of the head main body 30 (30*a*).

And, a part corresponding to the crystal phase K, namely, the protruding portion 46 of the head main body 30 is pressed (in a direction shown with an arrow) with a press machine, etc. and plastically deformed. Then, as shown in FIG. 27B, an aperture between an inner peripheral face 31*a* of the concave portion 31 and the chamfer 45 of the face body 1 is filled with the deformed protruding portion 46, and the face body 1 is fixed to the head main body 30 thereby. In this process, although the crystal phase K may be plastically deformed (bitten) by lateral pressure of the deformed opening edge of the head main body 30, the amorphous phase is not deformed, and the face body 1 (function of the face body 1) is not damaged.

Next, FIGS. 28 through 30B show a case that the face body 1 is fixed to the head main body 30 (30*a*) with a caulking member 47 (ninth preferred embodiment). Concretely, a stepped portion 48 is formed along the whole periphery of the concave portion 31 of the head main body 30 (30*a*), and the head main body 30 has an inclined aperture forming slope 49 outer than the stepped portion 48.

Figure 30A:
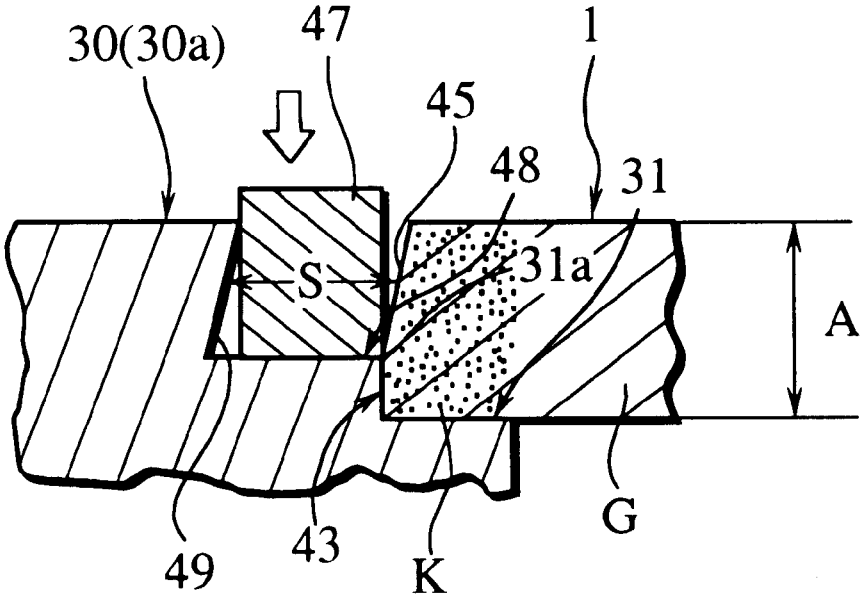
FIG. 30A is a cross-sectional explanatory view of an enlarged principal portion before plastic deformation.
Figure 30B:
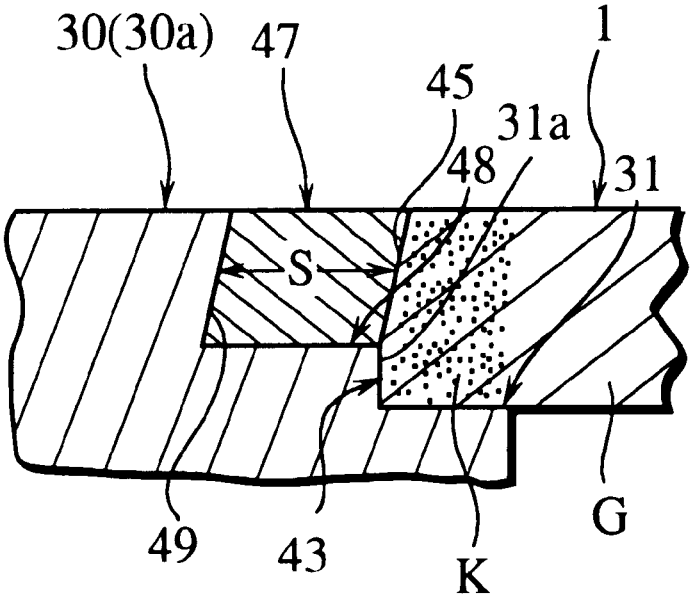
FIG. 30B is a cross-sectional explanatory view of the enlarged principal portion after the plastic deformation.
Figure 31:
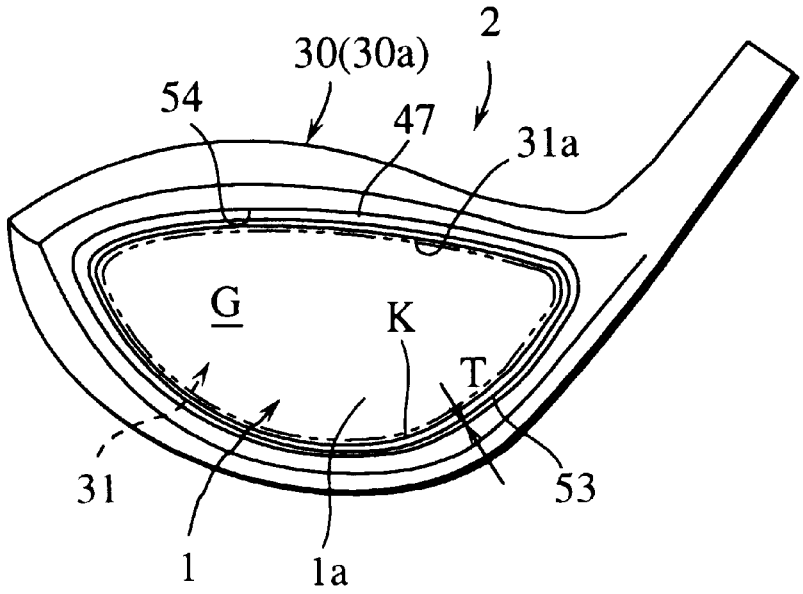
FIG. 31 is a front view showing tenth preferred embodiment of the golf club head.
Figure 32:
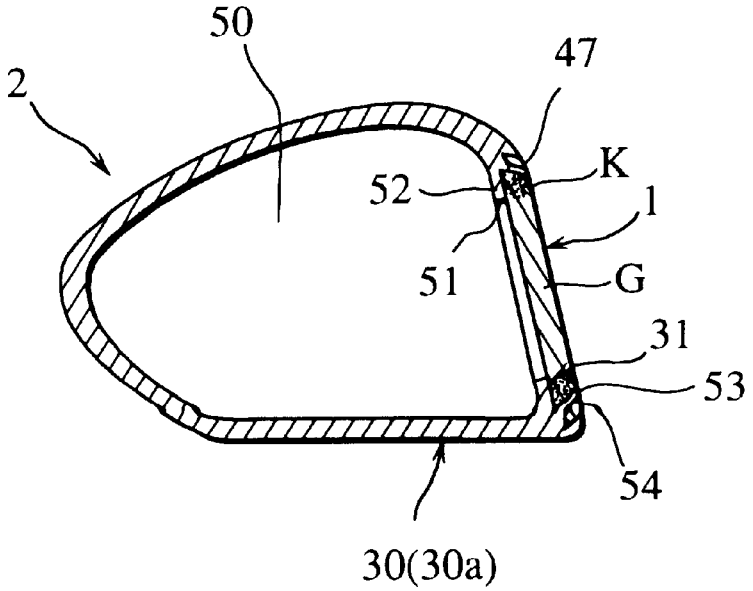
FIG. 32 is a cross-sectional side view showing the tenth preferred embodiment of the golf club head.
Figure 33A:
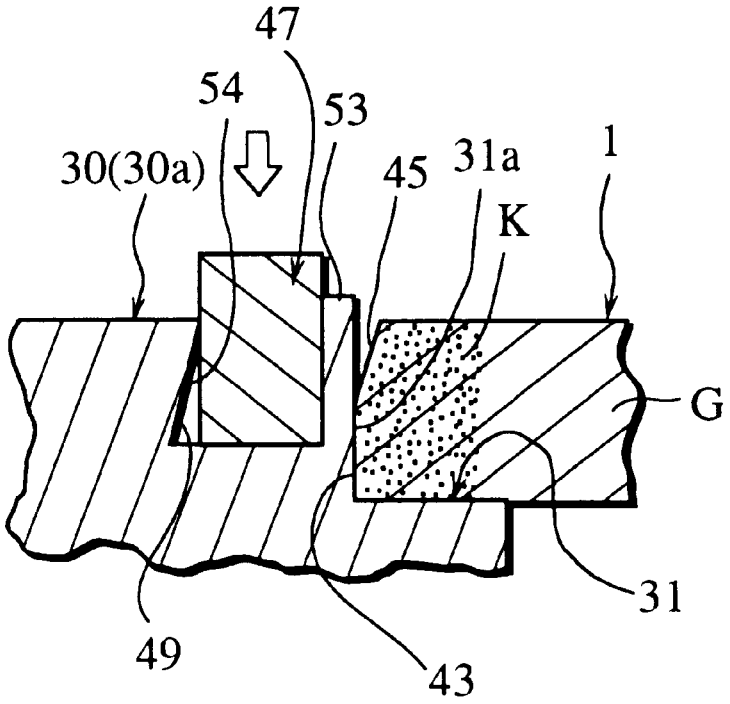
FIG. 33A is a cross-sectional explanatory view of an enlarged principal portion before plastic deformation.
Figure 33B:
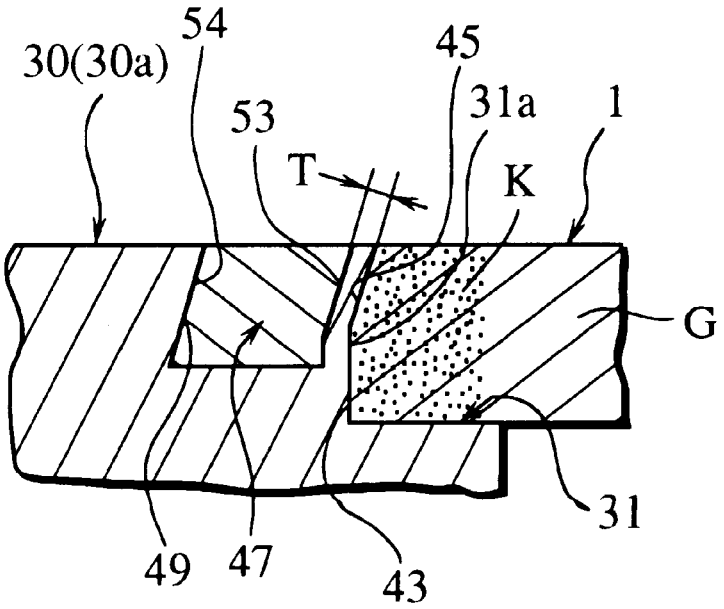
FIG. 33B is a cross-sectional explanatory view of the enlarged principal portion after the plastic deformation.

And, as shown in FIG. 30A, the face body 1 is fitted to the concave portion 31 of the head main body 30, the loop-shaped caulking member 47 of rectangular cross section is press-fitted to an aperture S between the inner peripheral face 31*a* of the concave portion 31 and the peripheral rim 43 of the face body 1, and plastically deformed. Then, as shown in FIG. 30B, an aperture between the caulking member 47 and the chamfer 45 of the face body 1 and a cavity between the caulking member 47 and the aperture forming slope 49 of the head main body 30 are filled, and the head main body 30 and the face body 1 are mutually connected and fixed. Also in this case, although the deformed caulking member 47 may get into the crystal phase K, the amorphous phase G of the face body 1 is not damaged for the plastic deformation of the crystal phase K.

Figure 29:
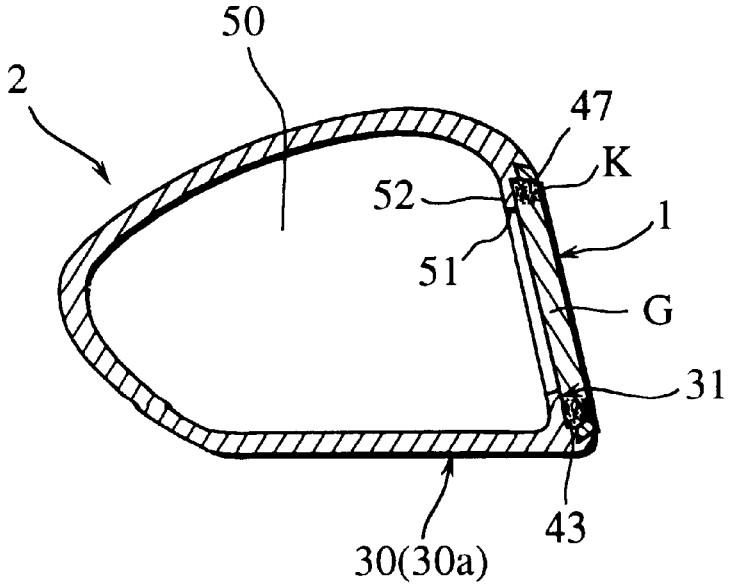
FIG. 29 is a cross-sectional side view showing the ninth preferred embodiment of the golf club head.

Further, FIG. 29 shows a cross-sectional view of a golf club head 2 in which 50 is a hollow chamber portion of the head main body 30 (30*a*), and 51 is a window portion opening to the hollow chamber portion 50. And, an inner brim portion 52 protrudes from an inner peripheral face of the window portion 51, and the inner brim portion 52 is a bottom face of the above-mentioned shallow concave portion 31. And, the window portion 51 may be omitted, and the head main body 30 may be formed with completely closed concave portion 31 formed as a shallow dish.

And, FIGS. 31 through 33B show a case that the face body 1 is fixed to the head main body 30 (30*a*) with plastic deformation of the caulking member 47 and the head main body 30 (30*a*) (tenth preferred embodiment). Concretely, a concave groove 54 is formed along the inner peripheral face 31*a* of the concave portion 30 of the head main body 30 through a side wall 53 of a small thickness dimension T, and an inclined aperture forming face 49 is formed on a lateral side of the concave groove opposite to the face body 1. And, the caulking member 47 is press-fitted to the concave groove 54 and plastically deformed, the side wall is deformed to the chamfer 45 side of the peripheral rim 43 (composed of the crystal phase K) of the face body 1, and the head main body 30 and the face body 1 are connected and fixed.

Many fitting methods for the face body 1 and the head main body 30 are thinkable besides the methods described with reference to FIGS. 25 through 33B. And, these fitting methods, which are not restricted to wood type golf club heads, are applicable to an iron type golf club head described later. In description of the iron type golf club head, members of same marks are similarly constructed as in the wood type golf club heads described above, so the description is partially omitted.

Figure 34:
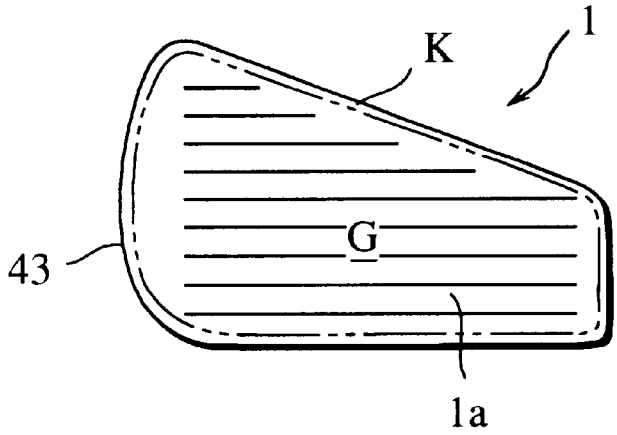
FIG. 34 is a front view showing a face body for an iron type golf club head.

FIG. 34 shows a face body 1 for an iron type golf club head composed of a hybrid of the amorphous phase G and the crystal phase K. And, the crystal phase K is (same as described above) disposed along the whole peripheral rim portion of the face body 1.

Figure 35:
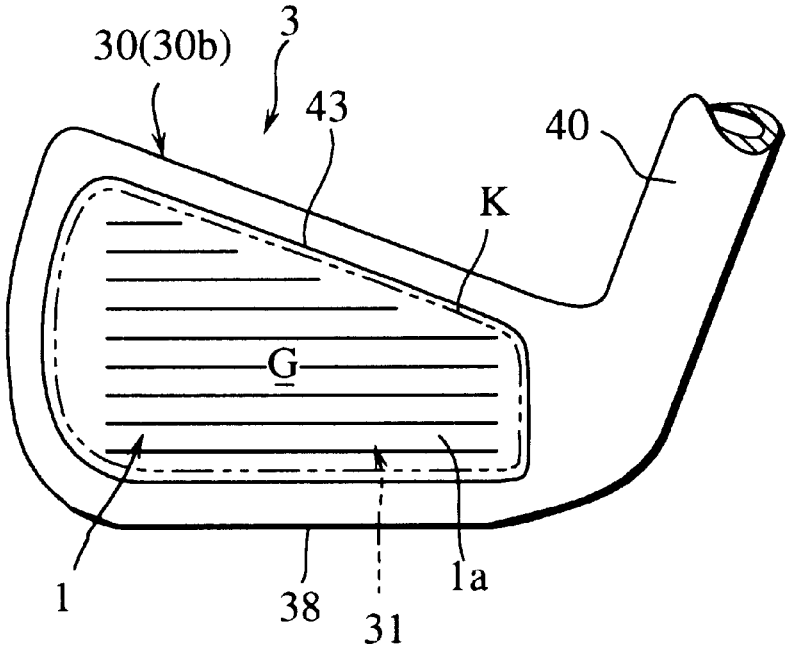
FIG. 35 is a front view showing eleventh preferred embodiment of the golf club head.
Figure 36:
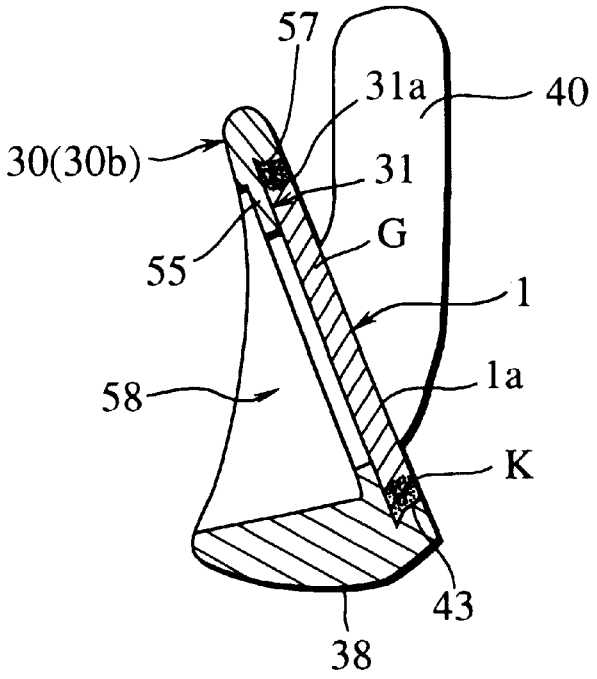
FIG. 36 is a cross-sectional side view showing the eleventh preferred embodiment of the golf club head.

FIGS. 35 and 36 show an iron type golf club head 3 made with the face body 1 (eleventh preferred embodiment). This club head 3 consists of a head main body 30 (30*b*) made of titanium, titanium alloy, stainless steel, etc., and the face body 1 having the peripheral rim 43 corresponding to the inner peripheral face 31*a* of the concave portion 31 and fixed to the concave portion for fitting 31 on the face 1*a* side of the head main body 30 (30*b*). 38 is a sole, and 40 is a neck portion.

And, a hollow portion 58 which connects (goes through) a face and a back face is formed in the head main body 30, an inner brim portion 55 protrudes from an inner peripheral face of the hollow portion 58, and the inner brim portion 55 is a bottom face of the above concave portion 31 for fitting the face body 1. The concave portion 31 may be formed as a shallow dish of which bottom face is completely closed (refer to FIG. 17). And, in a fitting method for the head main body 30 and the face body 1 of this case, (as described with reference to FIGS. 26A and 26B) the crystal phase K of the face body 1 is plastically deformed, and press-fitted to a concave portion 57 formed on a corner portion of the concave portion 31.

Figure 37:
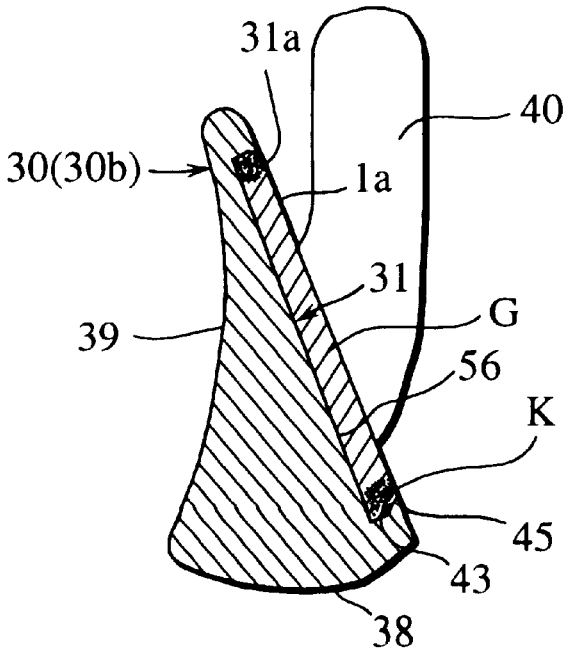
FIG. 37 is a cross-sectional side view showing the twelfth preferred embodiment of the golf club head.

And, FIG. 37 (as described with reference to FIGS. 27A and 27B) shows a fixed state of the face body 1 fitted to the concave portion 31 with plastic deformation of a head main body 30 (30*b*)(twelfth preferred embodiment). This head main body 30 has a concave portion 31 of which bottom face 56 is completely closed, and a back face.

Figure 38:
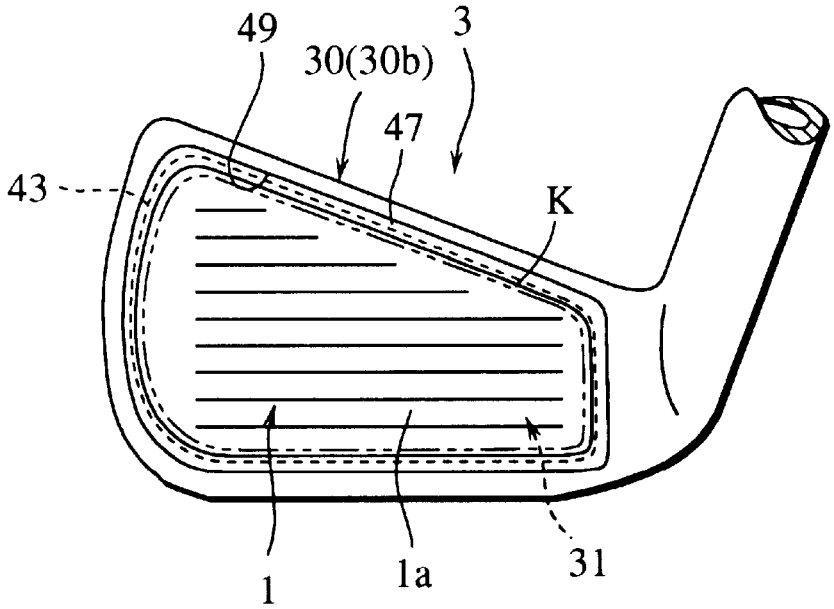
FIG. 38 is a front view showing thirteenth preferred embodiment of the golf club head.
Figure 39:
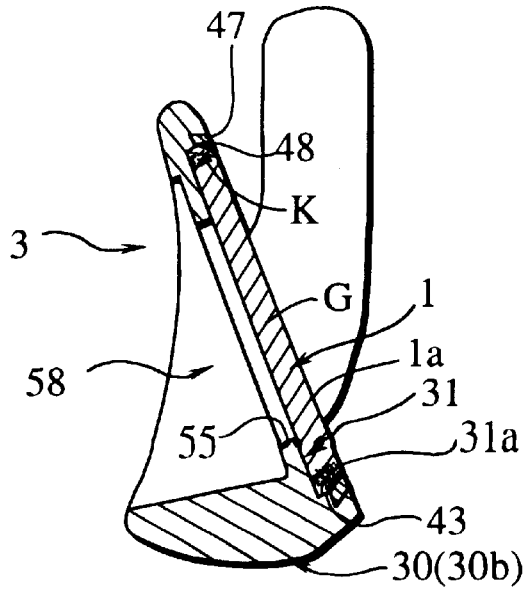
FIG. 39 is a cross-sectional side view showing the thirteenth preferred embodiment of the golf club head.

FIG. 38 and FIG. 39 show thirteenth preferred embodiment. In this iron type golf club head 3, (as described with reference to FIGS. 30A and 30B) the face body 1 is fitted to the concave portion 31 of the head main body 30 (30*b*), and a loop-shaped caulking member 47 is press-fitted to an aperture between the face body 1 and the head main body 30 (30*b*) formed with the stepped portion 48 on the concave portion 31 and plastically deformed.

Figure 40:
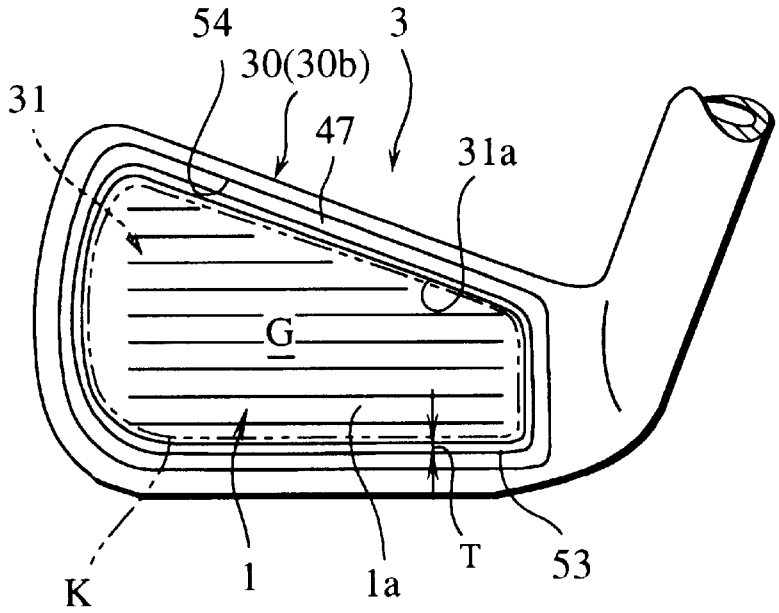
FIG. 40 is a front view showing fourteenth preferred embodiment of the golf club head.
Figure 41:
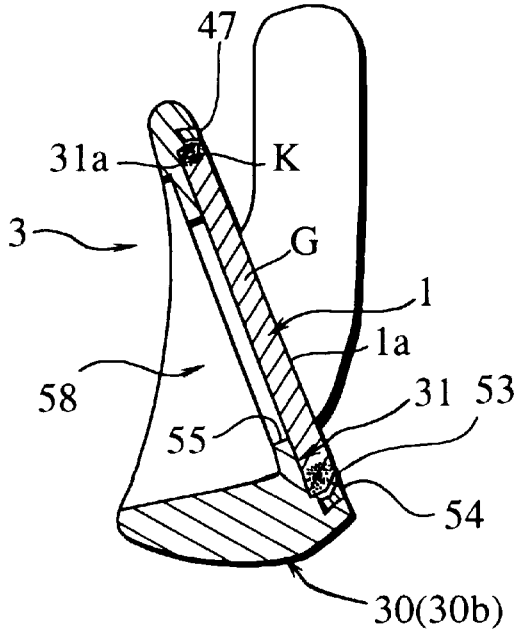
FIG. 41 is a cross-sectional side view showing the fourteenth preferred embodiment of the golf club head.

FIG. 40 and FIG. 41 show fourteenth preferred embodiment. In this embodiment, (as described with reference to FIGS. 33A and 33B) a loop-shaped caulking member 47 is press-fitted to the loop-shaped concave groove 54 on the head main body 30 (30*b*) and plastically deformed, a thin side wall 53 between the concave portion 31 and the concave groove 54 is plastically deformed to the face body 1 side, and the face body 1 is fixed to the head main body 30 (30*b*).

Figure 42:
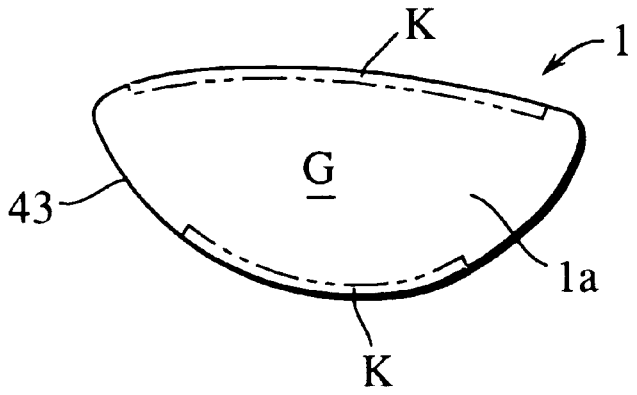
FIG. 42 is a front view showing another face body for a wood type golf club head.

In a golf club head of the present invention, as shown in FIG. 42, the crystal phase K may be disposed partially along the peripheral rim of the face body 1. In this case, in manufacturing process of the face body 1 (refer to FIGS. 22A, 22*b*, and 22C), metal material 26 is placed on predetermined positions along a side wall of the cavity portion 7 of the lower mold 5. And, the metal material 26 is fused, obtained molten metal 28 is pressed and transformed, and the face body 1 is formed. Then, as shown in FIG. 42, the face body 1 in which the crystal phase K is disposed on the predetermined positions on the peripheral rim is obtained. In FIG. 42, the face body 1 is for a wood type golf club head, and the crystal phase K is disposed on an upper side portion and a lower side portion of its peripheral rim.

Figure 43:
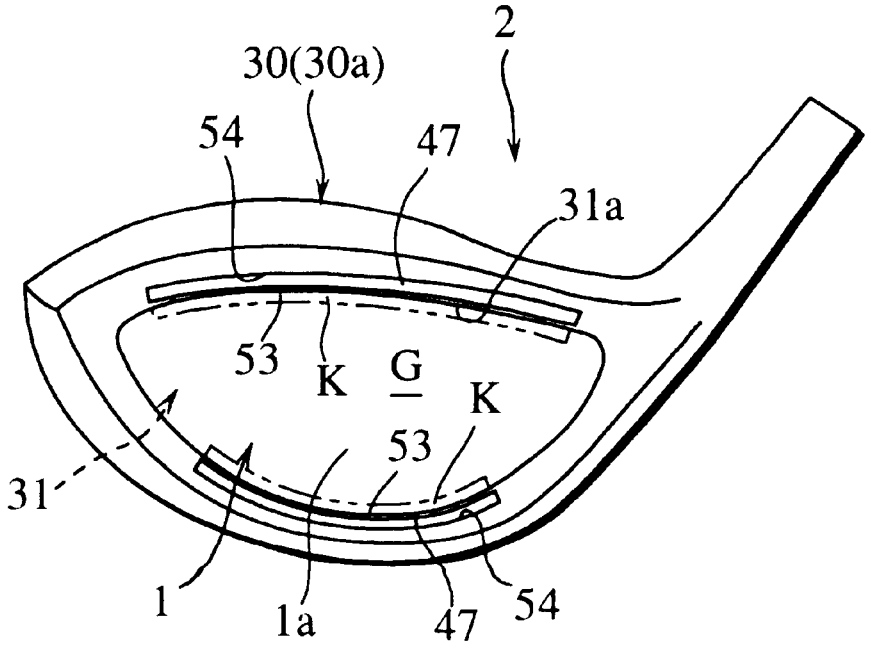
FIG. 43 is a front view showing fifteenth preferred embodiment of the golf club head.

And, for fitting the face body 1 to the head main body 30 (30*a*), as shown in FIG. 43 (fifteenth preferred embodiment), for example, the concave grooves 54 are formed on corresponding positions to the crystal phase K of the face body 1, the caulking member 47 is press-fitted to the concave grooves 54 and plastically deformed, the face body 1 fits to the concave portion 31 is fixed to the head main body 30.

Figure 44:
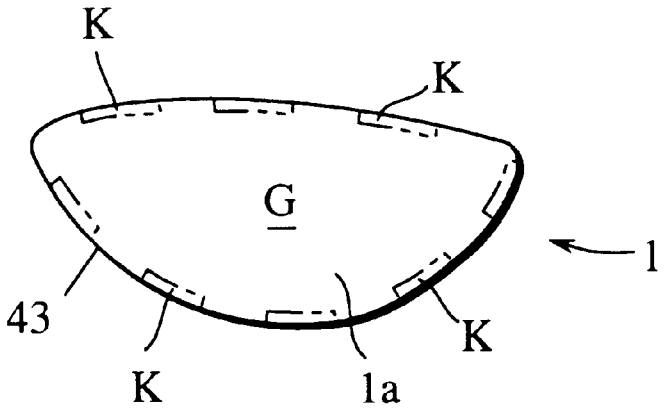
FIG. 44 is a front view showing still another face body for a wood type golf club head.
Figure 45:
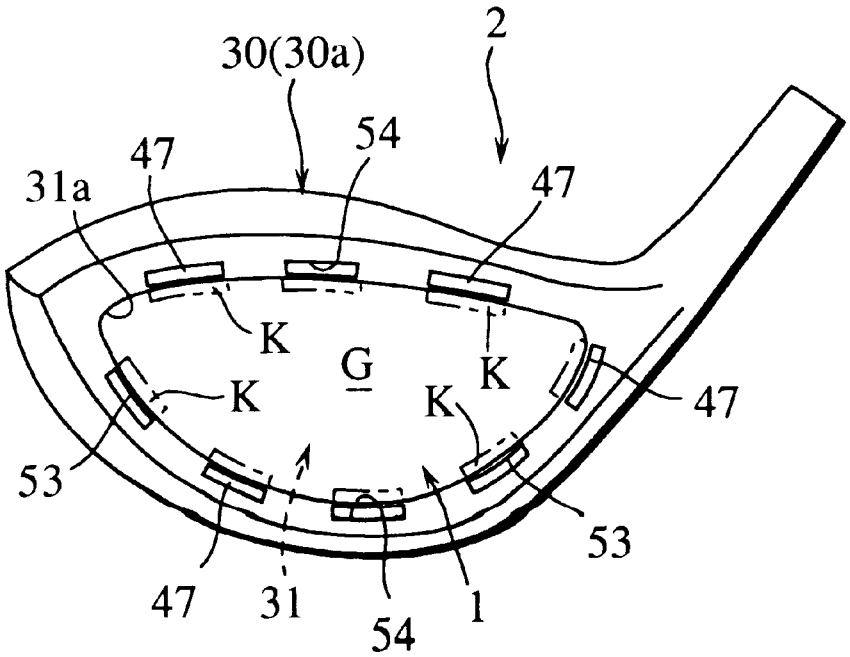
FIG. 45 is a front view showing sixteenth preferred embodiment of the golf club head.

And, as shown in FIG. 44 and FIG. 45 (sixteenth preferred embodiment), the crystal phase K may be disposed on the peripheral rim of the face body 1 intermittently (interruptedly). In this case, the concave groove 54 is formed on corresponding positions to each crystal phase K, the caulking member 47 is press-fitted to each concave groove 54 and plastically deformed, and the face body 1 is fixed to the head main body 30.

In case of a face body for an iron type golf club head, which is not shown in Figures, the crystal phase may be disposed on the peripheral rim portion partially, and the face body is fixed to the head main body as described with reference to FIG. 44 and FIG. 45.

Further, the present invention is not restricted to the preferred embodiments described above, for example, the crystal phase K may be disposed not only on the peripheral rim portion of the face body 1, but also on the reverse face side of the face body 1 (also in this case, volume of the crystal phase K is less than 50% of the whole volume of the face body 1).

And, number of the face body 1 of amorphous metal made at a time is not only one, but also plural. And, the predetermined configuration in the present invention may be a configuration of single face body or undetached plural face bodies. And, as the high energy heat source that fuses the metal material, not being restricted to a particular kind of equipment, for example, high frequency heat source, arc heat source, plasma heat source, electronic beam, laser beam, etc. are representative. And, single or plural units of these heat sources may be applied to the lower mold 5 of the press metal mold 6.

According to the golf club head relating to the present invention, it is possible to obtain a golf club head having excellent strength characteristics such as high impact resistance and high toughness for the amorphous phase G, and easy to set deformation amount to be the optimum value for a face body with increased rigidity (durability) of the face body 1 for the crystal phase K, because the face body 1 made by utilizing that the crystal phase K has higher elastic modulus in comparison with the amorphous phase G, and deformation of the crystal phase K by hitting impact is smaller than that of the amorphous phase G.

And, it is possible to obtain a golf club head having excellent strength characteristics such as high impact resistance and high toughness for the amorphous phase layer G', and easy to set deformation amount to be the optimum value for a face body with increased rigidity (durability) of the face body 1 for the crystal phase layer K', because the face body 1 made by utilizing that the crystal phase K has higher elastic modulus in comparison with the amorphous phase layer G' and deformation of the crystal phase layer K' by hitting impact is smaller than that of the amorphous phase layer G'.

Further, the face body 1, maintaining high strength characteristics, has high toughness. That is to say, the golf club head can keep excellent characteristics such as long flying distance, directionality, strength, toughness even after a long use, and life span as a golf club is extended thereby.

And, according to the golf club head relating to the present invention, local increase of rigidity (local reinforcement) is possible by that the crystal phase K is disposed only on a central portion of the face body 1 which is most greatly deformed by the hitting impact, and entire increase of rigidity (entire reinforcement) is also possible by that the crystal phase K is disposed on the entire reverse face 1*b* of the face 1*a*.

And, unpreferable parts for external appearance such as boundary line between the crystal phase layer K' and the amorphous phase layer G' is conveniently hidden by that the crystal phase layer K' is disposed on the reverse face 1*b* side of the face body 1.

Further, the golf club head is provided with excellent strength characteristics as a golf club head such as high impact resistance, high toughness, etc. by that the amorphous phase G is disposed on the central portion of the face body 1 which hits a golf ball, and a main portion surrounding the central portion (except the peripheral rim portion). And, the face body 1 can be fixed (caulk-fitted) to the head main body 30 with plastic deformation of the peripheral rim portion for the crystal phase K disposed on the peripheral rim portion of the face body 1.

And, even if the head main body 30 is made of a difficult material to be plastically deformed, the face body 1 is easily fixed (caulk-fitted) to the head main body 30 by plastic deformation of the peripheral rim portion of the face body 1 without deformation of the amorphous layer G. Further, all kinds of caulking, for example, plastic deformation of the head main body 30 side, and caulking with the caulking member 47, are applicable to the golf club head.

According to the manufacturing method relating to the present invention, it is possible to obtain a face body 1 having excellent strength characteristics such as high impact resistance, high toughness, etc. for the amorphous phase G, and high rigidity (durability) for the crystal phase K. And, the face body 1 can be made in one breath with good repeatability in a simple manufacturing process.

Further, in connection and fixation of the face body 1 and the head main body 30, if the head main body 30 is made of a difficult material to be plastically worked such as titanium alloy, etc., the face body 1 can be efficiently and stably fixed to the head main body 30 with plastic deformation of the crystal phase K of the face body 1. That is to say, the club head can be made without deformation of the amorphous phase G and damaging the functions as a face body 1. Further, even in case that the face body 1 is fixed by plastic deformation of the head main body 30, or the face body 1 is connected to the head main body 30 by lateral pressure of the head main body 30 and the caulking member 47, the lateral pressure is absorbed by the plastic deformation of the crystal phase K, and the golf club head can be made with the face body 1 maintaining the functions as a face body without damaging the amorphous phase G.

While preferred embodiments of the present invention have been described in this specification, it is to be understood that the invention is illustrative and not restrictive, because various changes are possible within the spirit and the indispensable features.

What is claimed is:

1. A golf club head, comprising:

a face body including an amorphous phase portion and a crystal phase portion, wherein the area of said crystal phase portion is more than 10% of a whole area of said face body observed in a direction at right angles with said face body.

2. A golf club head, comprising:

a face body including an amorphous phase layer and a crystal phase layer, wherein the area of said crystal phase layer is more than 10% of a whole area of said face body observed in a direction at right angles with said face body.

3. A golf club head, comprising:

a face body including an amorphous phase layer and a crystal phase layer, wherein a thickness of said face body is from 0.5 mm to 5.0 mm, wherein a thickness of said amorphous phase layer is, on average in a whole area of said face body, more than 50% of the thickness of said face body, and wherein a thickness of said crystal phase layer is from 0.01 mm to 3.0 mm.

4. The golf club head as set forth in claim 3, wherein the area of said crystal phase layer occupies more than 10% of a whole area of said face body observed in a direction at right angles with said face body.

5. The golf club head as set forth in claim 2 or 3, wherein said crystal phase layer is disposed on a reverse face side opposite to a face of said face body.

6. A golf club head, comprising:

a head main body having a concave portion; and a face body fixed to said concave portion, wherein said face body includes an amorphous phase portion and a crystal phase portion, and wherein said crystal phase portion is disposed along some parts of or entire peripheral rim portion of said face body corresponding to an inner peripheral face of said concave portion.

7. A golf club head, comprising:

a head main body with a concave portion; and a face body fixed to said concave portion for fitting said face body, wherein said face body includes an amorphous phase portion and a crystal phase portion, wherein said crystal phase portion is disposed along some parts of or entire peripheral rim portion of said face body corresponding to an inner peripheral face of said concave portion, and wherein said face body is fixed to said head main body by plastic deformation of said face body and/or said head main body and/or a caulking member at a corresponding position to said crystal phase portion along said peripheral rim portion of said face body.

* * * * *